US009211442B2

(12) United States Patent
Felker et al.

(10) Patent No.: US 9,211,442 B2
(45) Date of Patent: Dec. 15, 2015

(54) ANTI-SLICE GOLF BALL CONSTRUCTION

(75) Inventors: David L. Felker, Escondido, CA (US); Douglas C. Winfield, Madison, AL (US)

(73) Assignee: AERO-X GOLF, INC., Carlsbad, CA (US)

( * ) Notice: Subject to any disclaimer, the term of this patent is extended or adjusted under 35 U.S.C. 154(b) by 709 days.

(21) Appl. No.: 13/423,028

(22) Filed: Mar. 16, 2012

(65) Prior Publication Data

US 2012/0238378 A1 Sep. 20, 2012

Related U.S. Application Data

(60) Provisional application No. 61/453,230, filed on Mar. 16, 2011.

(51) Int. Cl.
*A63B 37/12* (2006.01)
*A63B 37/00* (2006.01)

(52) U.S. Cl.
CPC ..... *A63B 37/0006* (2013.01); *A63B 37/004* (2013.01); *A63B 37/006* (2013.01); *A63B 37/0033* (2013.01); *A63B 37/0035* (2013.01); *A63B 37/0045* (2013.01); *A63B 37/0047* (2013.01); *A63B 37/0051* (2013.01); *A63B 37/0064* (2013.01); *A63B 37/0066* (2013.01); *A63B 37/0075* (2013.01); *A63B 37/0077* (2013.01); *A63B 37/0097* (2013.01); *A63B 37/0082* (2013.01)

(58) Field of Classification Search
CPC ..... A63B 37/004; A63B 37/0055; A63B 37/0077; A63B 37/009; A63B 37/0091
USPC ..... 473/373, 374, 378
See application file for complete search history.

(56) References Cited

U.S. PATENT DOCUMENTS

| | | | |
|---|---|---|---|
| 700,660 | A | 5/1902 | Kempshall |
| 3,819,190 | A | 6/1974 | Nepela et al. |
| 4,063,259 | A | 12/1977 | Lynch et al. |
| 4,173,345 | A | 11/1979 | Pocklington |
| 4,744,564 | A | 5/1988 | Yamada |
| 4,762,326 | A | 8/1988 | Gobush |
| 4,979,747 | A | 12/1990 | Jonkouski |
| 4,991,852 | A | 2/1991 | Pattison |
| 5,078,402 | A | 1/1992 | Oka |

(Continued)

OTHER PUBLICATIONS

International Search Report and Written Opinion issued in related International Patent Application No. PCT/US2012/029531 dated Sep. 28, 2012, (16 pages).

(Continued)

*Primary Examiner* — Raeann Gorden
(74) *Attorney, Agent, or Firm* — Procopio, Cory, Hargreaves & Savitch LLP; Noel C. Gillespie

(57) ABSTRACT

A golf ball has a cover and a core which is made as a single piece or of two or more parts (for example an inner core covered by an outer core or mantle layer). The ball has non-spherical aspects in at least some parts and may also have different specific gravities in different parts of the ball. The different shaped ball parts combined with the different specific gravities of the materials for different ball parts results in a differential between the moments of inertia of the different spin axes. The golf ball is spherical, but the inner layers are not necessarily completely spherical or symmetrical layers or parts.

50 Claims, 16 Drawing Sheets

(56) References Cited

U.S. PATENT DOCUMENTS

| | | | |
|---|---|---|---|
| 5,518,246 | A | 5/1996 | Moriyama et al. |
| 5,564,708 | A | 10/1996 | Hwang |
| 5,782,702 | A | 7/1998 | Yamagishi et al. |
| 5,820,485 | A | 10/1998 | Hwang |
| 5,836,832 | A | 11/1998 | Boehm et al. |
| 5,846,141 | A | 12/1998 | Morgan et al. |
| 5,863,264 | A | 1/1999 | Yamagishi et al. |
| 5,902,193 | A | 5/1999 | Shimosaka et al. |
| 5,935,023 | A | 8/1999 | Maehara et al. |
| 5,957,786 | A | 9/1999 | Aoyama |
| 5,997,418 | A | 12/1999 | Tavares et al. |
| 6,045,461 | A | 4/2000 | Yamagishi et al. |
| 6,053,820 | A | 4/2000 | Kasashima et al. |
| 6,213,898 | B1 | 4/2001 | Ogg |
| 6,224,499 | B1 | 5/2001 | Ogg |
| 6,241,627 | B1 | 6/2001 | Kasashima et al. |
| 6,290,615 | B1 | 9/2001 | Ogg |
| 6,299,552 | B1 | 10/2001 | Morgan et al. |
| 6,409,615 | B1 | 6/2002 | McGuire et al. |
| 6,450,902 | B1 | 9/2002 | Hwang |
| 6,464,601 | B2 | 10/2002 | Ogg |
| 6,503,158 | B2 | 1/2003 | Murphy et al. |
| 6,511,389 | B2 | 1/2003 | Ogg |
| 6,537,159 | B2 | 3/2003 | Ogg |
| 6,551,203 | B2 | 4/2003 | Ogg |
| 6,602,153 | B2 | 8/2003 | Ogg |
| 6,652,341 | B2 | 11/2003 | Ogg |
| 6,658,371 | B2 | 12/2003 | Boehm et al. |
| 6,729,976 | B2 | 5/2004 | Bissonnette et al. |
| 6,796,912 | B2 | 9/2004 | Dalton et al. |
| 6,814,677 | B2 | 11/2004 | Ogg |
| 6,846,248 | B2 | 1/2005 | Nesbitt |
| 6,923,736 | B2 | 8/2005 | Aoyama et al. |
| 6,939,252 | B1 | 9/2005 | Stanczak et al. |
| 6,939,253 | B2 | 9/2005 | Ogg |
| 6,945,880 | B2 | 9/2005 | Aoyama et al. |
| 6,991,564 | B2 | 1/2006 | Sajima |
| 6,991,565 | B1 | 1/2006 | Kasashima |
| 7,018,308 | B2 | 3/2006 | Kasashima |
| 7,083,533 | B2 | 8/2006 | Kasahima et al. |
| 7,156,757 | B2 | 1/2007 | Bissonnette et al. |
| 7,175,542 | B2 | 2/2007 | Watanabe et al. |
| 7,226,369 | B2 | 6/2007 | Aoyama et al. |
| 7,229,364 | B2 | 6/2007 | Aoyama |
| 7,238,121 | B2 | 7/2007 | Watanabe et al. |
| 7,303,492 | B2 | 12/2007 | Aoyama et al. |
| 7,357,732 | B2 | 4/2008 | Watanabe et al. |
| 7,435,192 | B2 | 10/2008 | Sullivan et al. |
| 7,476,163 | B2 | 1/2009 | Kasashima |
| 7,481,723 | B2 | 1/2009 | Sullivan et al. |
| 7,491,137 | B2 | 2/2009 | Bissonnette et al. |
| 7,503,856 | B2 | 3/2009 | Nardacci et al. |
| 7,594,867 | B2 | 9/2009 | Nardacci |
| 7,604,553 | B2 | 10/2009 | Shinohara |
| 2001/0036873 | A1 | 11/2001 | Ogg |
| 2001/0041630 | A1 | 11/2001 | Ogg |
| 2002/0016227 | A1 | 2/2002 | Emerson et al. |
| 2002/0016228 | A1 | 2/2002 | Emerson et al. |
| 2002/0068649 | A1 | 6/2002 | Kennedy et al. |
| 2003/0114250 | A1 | 6/2003 | Nesbitt |
| 2003/0119609 | A1 | 6/2003 | Sullivan |
| 2003/0158002 | A1 | 8/2003 | Morgan |
| 2003/0190968 | A1 | 10/2003 | Kasashima |
| 2004/0080080 | A1 | 4/2004 | Dalton et al. |
| 2004/0106467 | A1 | 6/2004 | Ogg |
| 2004/0152541 | A1 | 8/2004 | Sajima |
| 2004/0157682 | A1 | 8/2004 | Morgan et al. |
| 2004/0254031 | A1 | 12/2004 | Ninomiya et al. |
| 2004/0254033 | A1 | 12/2004 | Ogg |
| 2005/0064958 | A1 | 3/2005 | Sullivan et al. |
| 2005/0079931 | A1 | 4/2005 | Aoyama et al. |
| 2006/0019772 | A1 | 1/2006 | Sullivan et al. |
| 2006/0199667 | A1 | 9/2006 | Jones |
| 2006/0264271 | A1 | 11/2006 | Veilleux et al. |
| 2007/0010342 | A1 | 1/2007 | Sato et al. |
| 2007/0049423 | A1 | 3/2007 | Nardacci et al. |
| 2007/0167257 | A1 | 7/2007 | Sullivan et al. |
| 2007/0219020 | A1 | 9/2007 | Sullivan et al. |
| 2008/0161135 | A1 | 7/2008 | Kasashima et al. |
| 2008/0220907 | A1 | 9/2008 | Aoyama et al. |
| 2009/0209367 | A1 | 8/2009 | Stefan et al. |
| 2009/0247325 | A1 | 10/2009 | Sullivan et al. |
| 2010/0075776 | A1 | 3/2010 | Nardacci et al. |
| 2010/0125005 | A1 | 5/2010 | Umezawa |
| 2011/0160001 | A1* | 6/2011 | Nanba et al. ..... 473/377 |
| 2011/0207554 | A1* | 8/2011 | Nanba et al. ..... 473/372 |
| 2011/0207555 | A1* | 8/2011 | Nanba et al. ..... 473/373 |

OTHER PUBLICATIONS

Extended European search report and search opinion for European patent application No. 12758322.7 dated Dec. 2, 2014, 8 pages.

* cited by examiner

ANTI-SLICE GOLF BALL CONSTRUCTION

RELATED APPLICATION

The present application claims the benefit of U.S. Provisional Pat. App. Ser. No. 61/453,230 filed on Mar. 16, 2011, the contents of which are incorporated herein by reference.

BACKGROUND

1. Field of the Invention

This invention relates generally to the field of golf balls and, more particularly, to golf ball with a weight distribution designed for straighter flight performance.

2. Related Art

The flight path of a golf ball is determined by many factors. Several of the factors can be controlled to some extent by the golfer, such as the ball's velocity, launch angle, spin rate, and spin axis. Other factors are controlled by the design of the ball, including the ball's weight, size, materials of construction, and aerodynamic properties.

A golf ball can be represented in three dimensional space with three orthogonal axes intersecting in the center of the ball. Often these are called the x, y and z axes. It is common to represent the golf ball with two of the axes co-planar with the ball's equatorial plane and the third axis (z axis) perpendicular to the equatorial plane and running through the poles of the ball.

When a golf ball is rotating in space, it is said to be "rotating about its spin axis". When a golf ball is struck with a club it generally makes the ball rotate with a backward spin. Whether the resulting spin axis coincides to one of the three principle axes of the ball depends on how the ball was oriented before club impact and the type of club impact that occurred (straight, hook or slice club action).

SUMMARY

According to one embodiment, a golf ball is designed with an asymmetrical weight distribution causes the ball to exhibit what may be defined as a moment of inertia (MOI) differential between two or three of the orthogonal spin axes or x, y and z axes, where the x and y axes are co-planar with the equatorial plane of the ball and the z axis extends through the poles. In a ball with a differential MOI, the spin axis with the highest MOI is the preferred spin axis and most importantly a golf ball with a MOI differential and preferred spin axis resists tilting of the ball's spin axis when it is hit with a slice or hook type golf club swing. The ball's resistance to tilting of the spin axis means the ball resists hooking and slicing (left or right dispersion from the intended direction of flight). The mechanism for this hook and slice resistance appears to occur on the clubface during club-ball impact. When the preferred spin axis also corresponds to a low aerodynamic lift ball configuration (the ball's lift generated by the dimple pattern can be different in different orientations, even when velocity and spin are identical), the ball has less tendency to slice and hook after the ball leaves the clubface with the preferred spin axis tilted right or left of horizontal orientation (horizontal orientation is defined as parallel to the ground and perpendicular to the intended direction of flight). The lift force is what generates the ball height on a straight shot and it is also responsible for the right and left directional movement (dispersion) of the ball when it is hit with a slice or hook club action.

In one embodiment, a golf ball has a cover and a core. The core may be a single piece or can be made up of two or more parts, for example an inner core covered by an outer core. The cover may also be a single piece or be made up of two or more parts. A layer between the inner core and cover may be defined as a mantle layer, and in some cases may be an outer core layer and in other cases it may be an inner cover layer, depending on materials and construction. In one embodiment, one or more parts of the ball have non-spherical aspects, and the different parts may also have different specific gravities. The different shaped ball parts combined with the different specific gravities of the materials for different ball parts produces the MOI differential between spin axes. The golf ball is spherical, but the inner layers are not necessarily completely spherical or symmetrical layers or parts.

The ball may also have an asymmetrical dimple pattern on the outer surface designed to augment the slice and hook correcting differential MOI properties.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1A:
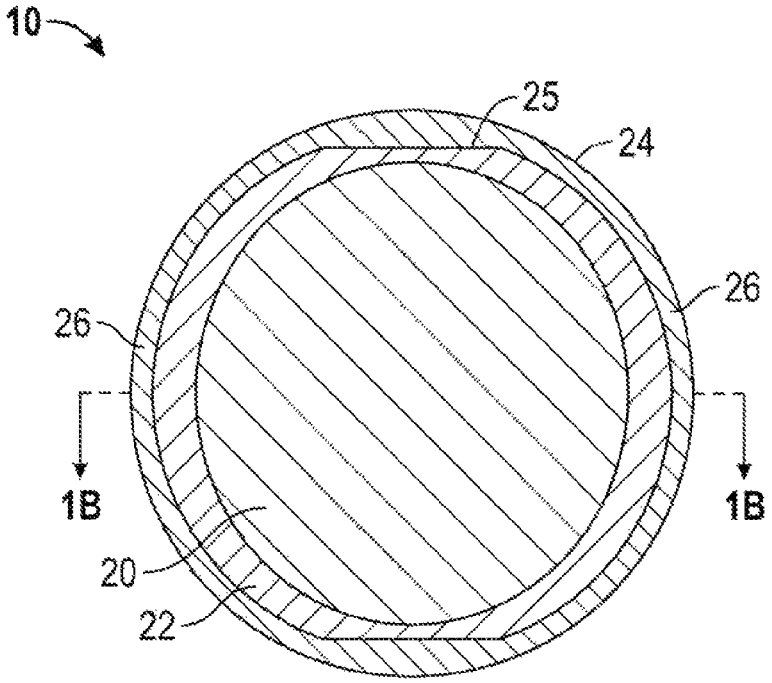
FIG. 1A is a cross-sectional view taken through the poles of a first embodiment of a golf ball having a non-spherical core.

Certain embodiments as disclosed herein provide for a golf ball which has non-spherical aspects in various combinations of the core and cover parts, so as to provide a moment of inertia (MOI) differential between the spin axes of the ball. In some embodiments, different parts may also have different specific gravities.

After reading this description it will become apparent to one skilled in the art how to implement the invention in various alternative embodiments and alternative applications. However, although various embodiments of the present invention will be described herein, it is understood that these embodiments are presented by way of example only, and not limitation.

It is common to represent the golf ball with two of the axes (x-axis and y-axis) co-planar with the ball's equatorial plane and the third axis (z-axis) perpendicular to the equatorial plane and running through the poles of the ball. In the following description, these three axes are called the principle axes or the orthogonal spin axes.

FIGS. 1A to 24 illustrate a number of different embodiments of a golf ball designed to have a MOI differential designed such that, when properly aligned before taking a golf shot, the ball resists hooking or slicing. FIGS. 25 to 29 illustrate some alternative dimple patterns which may be applied to the outer surface of the golf balls of FIGS. 1A to 24.

In other embodiments, the ball may have non-spherical aspects of various combinations of the core and cover parts which have different specific gravities. The different shaped ball parts combined with the different specific gravities of the materials for different ball parts is what causes the MOI differential between spin axes. The golf ball is spherical, but the inner layers are not necessarily completely spherical or symmetrical layers or parts.

In the embodiments illustrated in FIGS. 1A to 16, the core of the golf ball is composed of a mantle layer (outer core) and an inner core, while in the embodiment of FIGS. 17 to 24, a one-piece core is shown. In reality, the core may be made of one material in one piece or multiple materials and/or multiple layers or pieces. In the following discussion, whenever the core is referred to in general, it can be a one piece or multi-piece core even though it is referred to only as a core. The mantle layer in some embodiments is a core layer directly below the cover. There may be one or more mantle layers and one or more cover layers.

In the embodiments of FIGS. 1A to 24, the core is not completely spherical. It has regions that are larger or smaller in radius. The core can have high or low regions, areas where material is added or removed, or may be of many other completely or partially non-spherical shapes, just a few of which are described here. The cover is placed over the core, thus it has thicker or thinner regions that corresponding to the topography of the core. In other words, an inner surface of the cover which opposes the at least partially non-spherical surface of the core is of complementary at least partially non-spherical shape, resulting in thicker and thinner regions if the outer surface of the cover is substantially spherical. The cover may be a single layer or may comprise two, three or more cover layers over the core, so that the outer cover is spherical and uniform in thickness and the layer or layers below, which would be called the inner cover layer or layers (these also might be considered "mantle layers"), would not all be of uniform thickness. A multiple layer cover with different types of materials such as Surlyn, polyurethane or other materials used for golf ball covers and mantle layers could also be envisioned, each with different specific gravities, colors, and physical properties. However, the major point is that somewhere in the construction of the ball is at least one layer or ball part that is not uniform in thickness or not uniform in radius and because of this design element and the proper selection of specific gravity for the different ball components, the ball has a different moment of inertia when rotating about at least one of the principle axes (by "principle axes" is meant the 3 orthogonal axes of a ball usually defined by x, y and z). The axes are usually defined as two being perpendicular to each other and residing in equatorial plane, and the third being perpendicular to the equatorial plane and going through the poles. In some embodiments, the MOI of the ball as measured about each of the orthogonal axes can each be a different value or the MOI can be substantially the same for two axes and different for the third.

In each embodiment, at least two components of the ball have different specific gravities. One is denser than the other. The cover can be more or less dense than the core. The mantle layer can be more of less dense than the cover, the mantle layer can be more or less dense than the core, two mantle layers can differ in density, two cover layers can differ in density, etc. In any case, the ball will have a MOI differential depending upon the shape of the core, cover and mantle layers and the density differences among them. A spherical inner core or uniform thickness cover or uniform thickness mantle layer can be higher or lower specific gravity compared to any of the other mantle, cover or core layers.

Figure 1B:
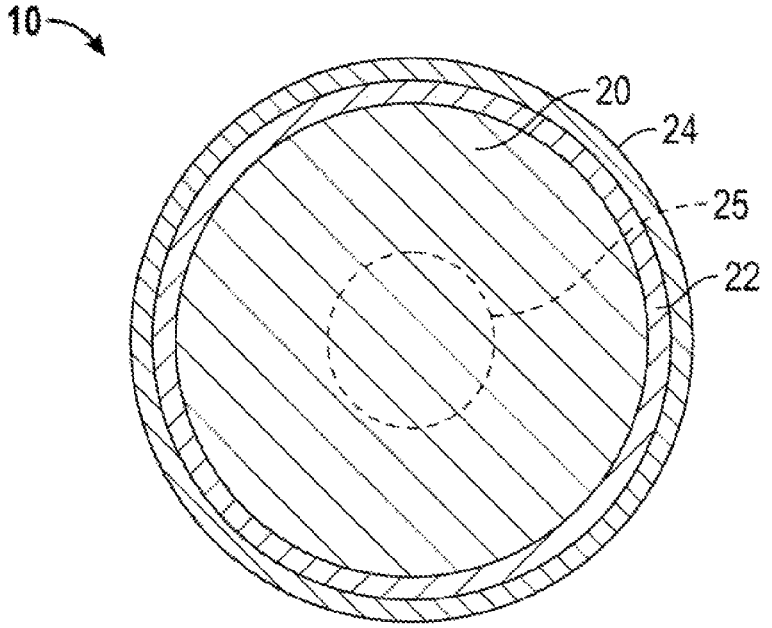
FIG. 1B is a cross-sectional view on the lines 1B-1B of FIG. 1A, taken through the equatorial plane of the ball.
Figure 2:
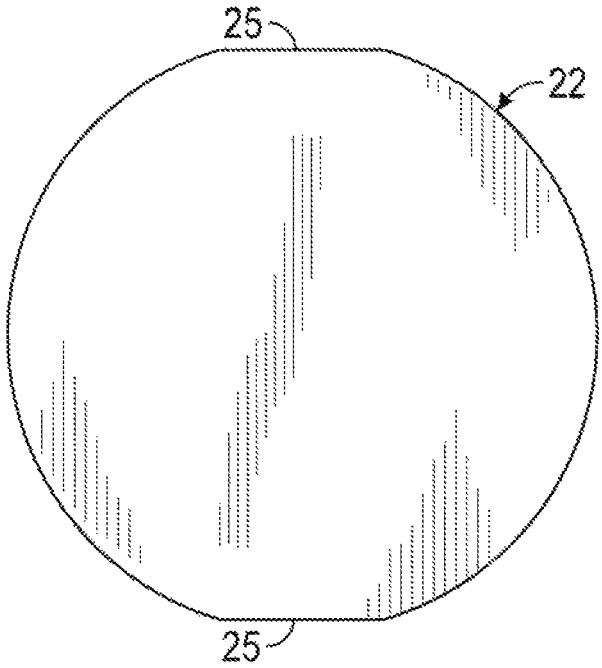
FIG. 2 is a front elevation view of the core of the ball of FIGS. 1A and 1B.

As illustrated in FIGS. 1A, 1B and 2, a first embodiment of a golf ball 10 constructed to resist hooking and slicing has a two part core comprising an inner core 20 covered by an outer core or mantle layer 22, and an outer cover 24. FIGS. 1A and 1B illustrate two perpendicular cross sectional views of the ball. In the first embodiment, the mantle layer 22 of the core is partially non-spherical and has diametrically opposite flattened areas or spots 25 on opposite sides of the ball in the same region that the known Polara ball has deep polar dimples. This means that the ball has a higher moment of inertia when rotating in the PH orientation than in other orientations or spin axes. Different parts of the ball may also be of different materials having different specific gravities, as explained in more detail below. The two removed areas or flattened areas 25 are exactly the same size and shape. They are 180 degrees opposite from each other. This core shape causes the cover to have a complementary inner surface shape with two circular regions 26 that are opposite each other and oppose the flattened areas 25, and are thicker than the rest of the cover. In alternative embodiments, the core may be a single piece or may have more than two parts.

FIG. 2 illustrates the core of design "A1" (FIGS. 1A and 1B) showing the outer core (mantle) 22 over the inner core 20, with the cover layer 24 removed. The inner core in this case has a radius of 0.74 inches, and the outer core has a radius ranging from 0.76 to 0.79 inches. This design has two regions where a disk shaped element has been removed from the core and the two regions are 180 degrees opposite of each other. The radius at the center of each of these areas is 0.76 inches and rises to 0.79 inches at the edges of the disks (the diagram may not have the exact correct aspect ratio and it may appear that the core is not spherical, however, the inner core for this example and the examples of FIGS. 3A to 4 and 7 to 12 are meant to be spherical). The height of the disk removed from each pole is at most 0.03 inches. This same basic design idea could be used with larger or smaller cores ranging from less than 1 inch in diameter to something approaching less than 0.015 inches than the outside diameter of the ball. The thickness of the cover of the ball and the outside diameter of the ball limit the maximum diameter of the core, but the size of the disk removed from each end could vary from as little as 0.001 inch radius up to almost the entire radius of the core (at which point the core would become a thin disk shaped object). In all of these cases the MOI differential would be smallest to largest going from the least amount of material removed from the core to the disk shaped material with enough thickness and specific gravity difference between the other layers as to maximize the overall MOI differential of the ball.

This embodiment and all other ball construction embodiments described below in connection with FIGS. 3A to 24 can be combined with surface features or dimples forming a symmetrical pattern or can be combined with an asymmetrical pattern such as that of the original Polara golf ball (deep dimples around the equator and shallow dimples on the poles) or the asymmetrical dimple pattern of the new Polara Ultimate Straight golf balls that have deeper dimples on the poles and shallow dimples around the ball's equator, or the dimple patterns of any of the non-confirming balls described in co-pending application Ser. No. 13/097,013 filed on Aug. 28, 2011, the contents of which are incorporated herein by reference. An asymmetrical dimple or surface feature pattern is one which is non-conforming or not spherically symmetrical as defined by the United States Golf Association (USGA) rules.

In the case of the Polara Ultimate Straight dimple pattern combined with design "A1", if the flat spot on the core was centered with the pole of the dimple pattern (the deep dimpled region), and the density of the materials for the core and cover mantle layer we chosen so that core was higher specific gravity than the cover, then the MOI differentials caused by the ball construction and dimple pattern would reinforce each other and create a larger MOI differential than when just the Polara dimple pattern was used on a symmetrical ball construction or when a symmetrical dimple pattern was combined with the ball construction of FIGS. 1A to 2, such as the symmetrical dimple patterns described in co-pending application Ser. No. 12/765,762 filed on Apr. 22, 2010, the contents of which are incorporated herein by reference, or other symmetrical dimple patterns.

Another example similar to the ball 10 of FIGS. 1A to 2 but not shown in the drawings, would be a core with 3, 4, 5 or more regions removed from the core and all the regions symmetrically positioned about the core so that they were in the same plane and were equally spaced from each other so as to create a ball that has the center of gravity in the physical center of the core. The regions could be the same size and shape as each other, or they could be different sizes and shapes. In this example the regions removed from the core have a flat base, but in other instances they could have a non-flat base, such as a spherical or elliptically shaped based, for example they may be more scooped out of the core as opposed to sliced off of the core. Alternatively, the shapes could be indented regions with high or low spots within each region, or the core regions could be any combination of any of these suggested shapes. The idea is simply to remove portions of the core to allow for the establishment of an asymmetry that establishes an MOI differential that helps prevent part or most of a hook or slice. The removed regions of the core could also exist in more than one plane as long as they still established a net asymmetry in the core weight distribution and the center of gravity was still in the center of the ball.

Figure 3A:
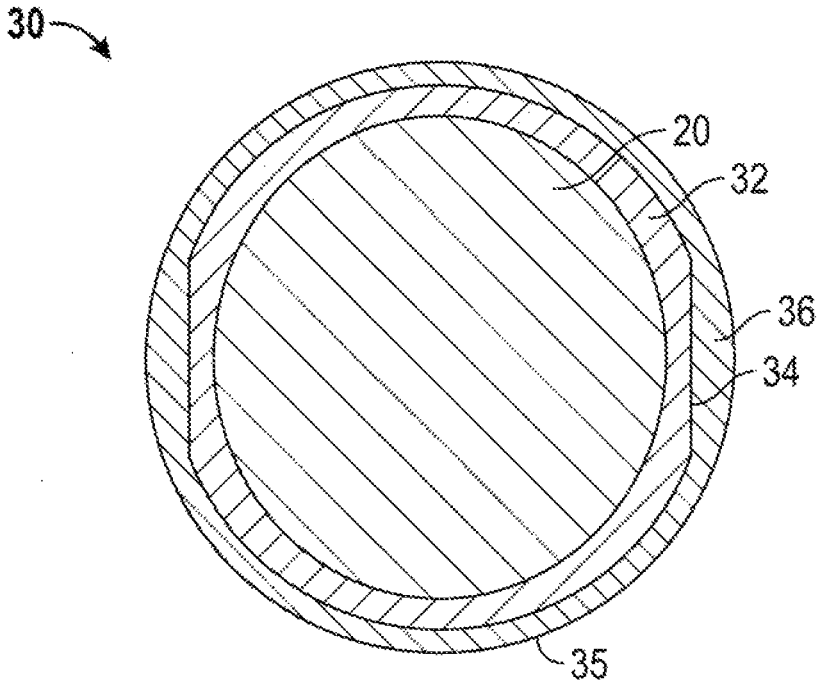
FIG. 3A is a cross-sectional view taken on an x-axis through the equatorial plane of a second embodiment of a golf ball with an non-spherical core.
Figure 3B:
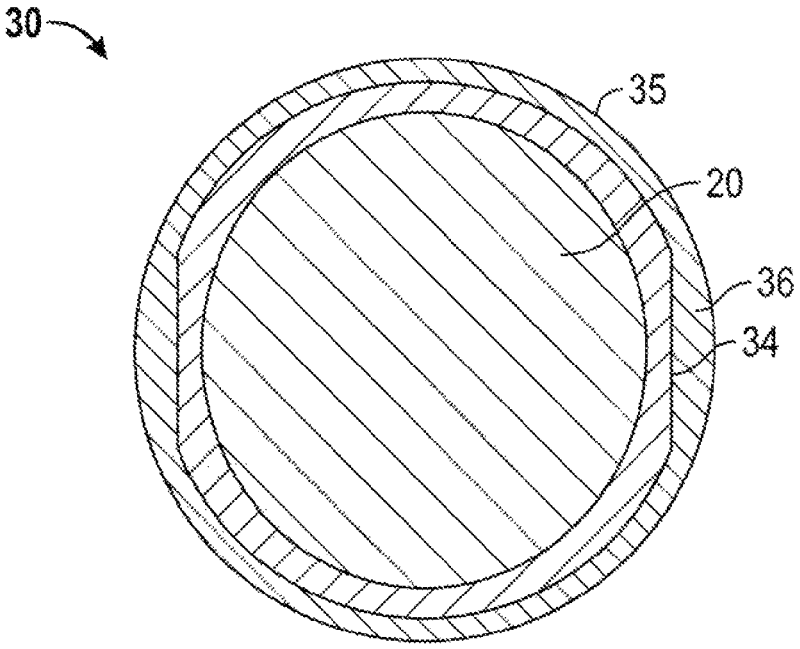
FIG. 3B is a cross-sectional view of the ball of FIG. 3A taking along the orthogonal y-axis in the equatorial plane.
Figure 4:
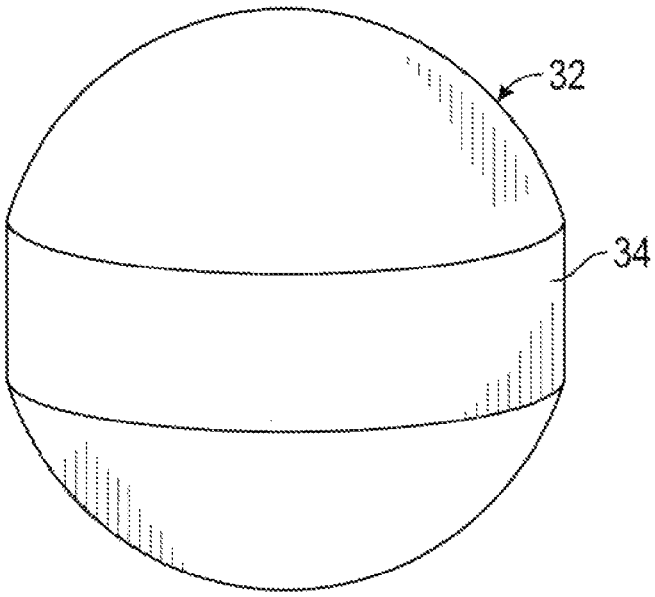
FIG. 4 is a front elevation view of the core of the ball of FIGS. 3A and 3B.

FIGS. 3A to 4 illustrate a modified ball 30 (design "B1") which is similar to ball 10, and like reference numbers are used for the various parts of ball 30. However, in this alternative, rather than providing diametrically opposite flat regions on the core or mantle, mantle 32 has an annular band 34 removed from around the entire core, and the cover 35 has an opposing surface of complementary shape with a thicker band 36 of material surrounding band 34. In this design, the center of gravity of the core has not moved and is still in the center of the core. If the ball is to roll normally, it is important that the center of gravity for all of these designs be close to the center of the golf ball, as determined from the intersection point of the 3 orthogonal axes of the ball. In this embodiment, the dimple pattern on the outer cover may correspond to the Polara dimple pattern having deep dimples around the equator, or other symmetrical or asymmetrical dimple patterns. In this embodiment, the high MOI orientation is the POP orientation.

FIG. 4 illustrates the core of the ball 30 of FIGS. 3A and 3B (Design "B1"), with the outer layer removed, showing the outer core (mantle) 32 over the inner core 20. The inner core in this case has a radius of 0.74 inches, and the outer core has a radius ranging from 0.76 to 0.79 inches. The 0.74 radius occurs at the center of area where material has been removed in a band shape around the core. At the edges of the band the core radius is equal to the radius everywhere outside the band.

One of more parallel or non-coplanar bands could also be used to create a MOI differential. The bands could be wider or more narrow and thicker or thinner than shown in this example. Obviously the wider the band, the smaller the underlying core radius would have to be in order to maintain the core as a perfectly spherical unit, not intersecting with the band on the outer core (mantle layer). In other embodiments, the outer cones may have flat portions at the poles as well as one or more flattened bands extending around the ball.

Figure 5:
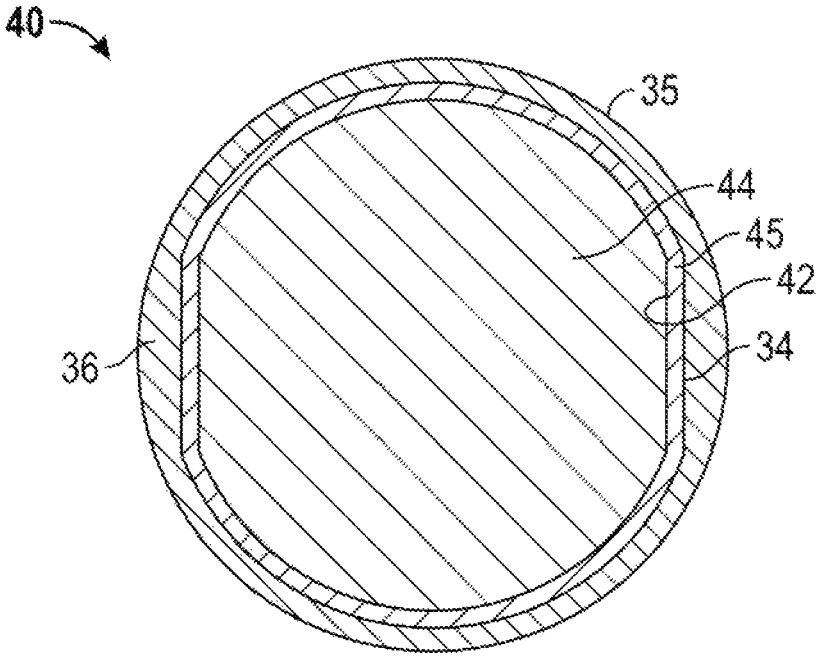
FIG. 5 is a cross-sectional view through the poles of a third embodiment of a golf ball having a non-spherical inner and outer core.
Figure 6:
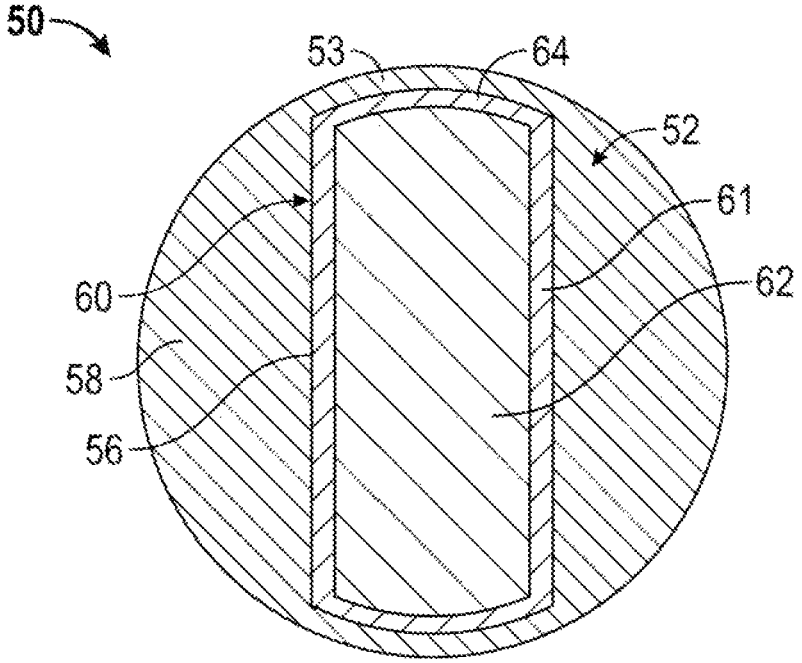
FIG. 6 is a cross-sectional view through the poles of a fourth embodiment of a golf ball which has narrow banded inner core and a banded outer core or mantle layer.

FIG. 5 illustrates a modification of the ball 30 of FIGS. 3A to 4. In the ball 40 of FIG. 5, a golf ball core is illustrated in which the underlying inner core 44 also has a banded region 42 corresponding to banded region 45 in the mantle layer 46. The bands in the two core layers could be the same or different widths. The dimension of the bands could range in size and thicknesses on the order of 0.001 wide (in which case they would create very little MOI differential) to the modified embodiment of a ball 50 illustrated in FIG. 6 where the core 60 has core layers 61, 62 which are disk shaped pieces having part spherical ends 64 (in which case they create a large MOI differential for the ball). A cover layer 52 having a spherical outer surface surrounds core 60, and thus has thinner regions 53 around part spherical ends 64 and significantly thicker regions 58 around the bands or opposite faces 56 of the disk shaped core pieces.

Figure 7:
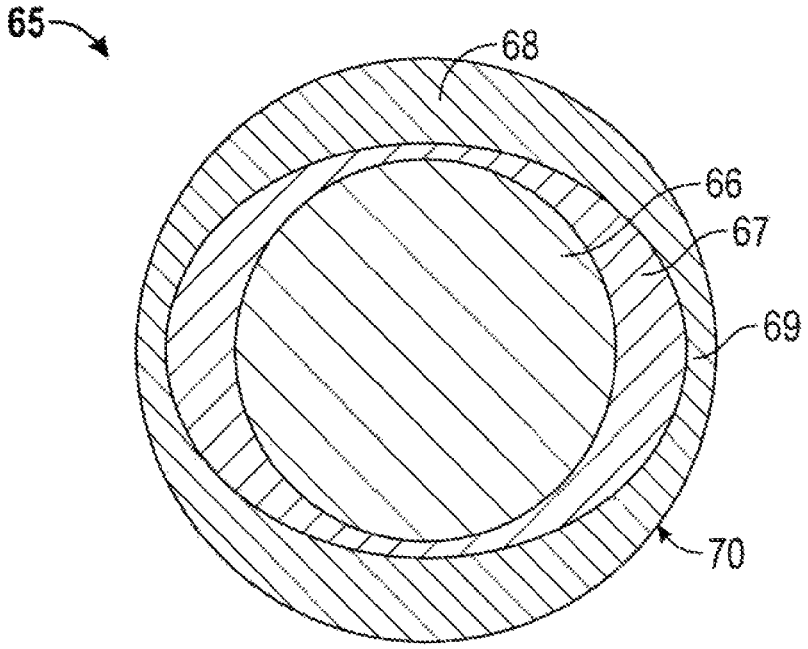
FIG. 7 is a cross sectional view of a fifth embodiment of a golf ball with an oblong core.

FIG. 7 illustrates another embodiment of a golf ball 65 (design "C1") which has an ellipsoid type core to establish the asymmetry necessary for creating the differential MOI. A number of designs are also possible where multiple ellipsoid shaped core shapes are combined to form a core that still has a MOI differential and the center of gravity of the core is still in the center of the core. In the embodiment of FIG. 7, the inner core 66 is spherical, while the outer core layer or mantel 67 is of ellipsoidal shape, having thicker regions 68 and thinner regions 69, with the outer cover 70 having an opposing inner surface of complementary elliptical shape, so that the cover is thinner adjacent the thicker regions of the mantel 67. Any combination and any number of each of the designs of FIGS. 1A to 6 can be combined to give further examples that would produce a ball with a differential MOI and would still have the center of gravity of the ball in the center of the ball (thus it would roll without wobbling).

Figure 8:
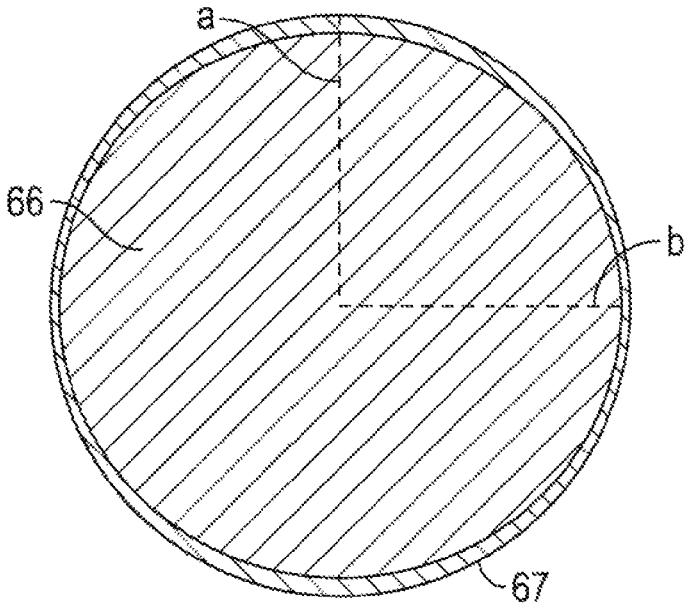
FIG. 8 is a cross-sectional view of a sixth embodiment of a golf ball which has a less elongated core than the embodiment of FIG. 7.

FIG. 8 illustrates one example of possible dimensions for an ellipsoid like core of a ball similar to that of FIG. 7 (Design "C1") showing the outer layer removed to expose the outer core (mantle) 67 over the inner core 66. The inner core in this case has a radius of 0.74 inches, and the outer core has a radius ranging from 0.74 to 0.79 inches. This core is ellipsoid shaped. At its point of greatest width, the ellipsoid has a radius a of 0.79 inches and at its narrowest point it has a radius to of 0.74 inches.

Figure 9:
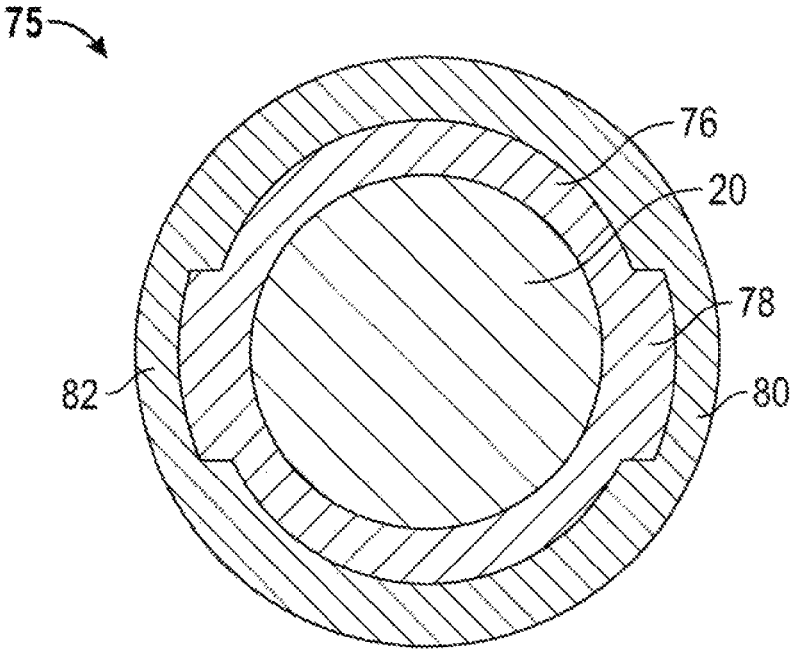
FIG. 9 is a cross-sectional view of a seventh embodiment of a golf ball with a non-spherical core.
Figure 10:
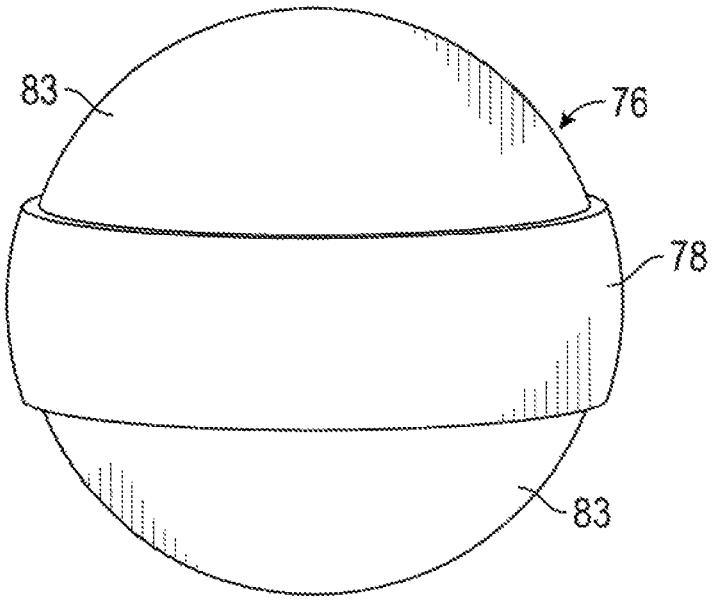
FIG. 10 is a front elevation view of the core of the golf ball of FIG. 9.

FIGS. 9 and 10 illustrates another embodiment of a golf ball 75 (design "D1") which has a two piece core with an inner core 20 and an outer core layer or mantle 76 that encircles the core 20 and has a raised band 78 around the outer surface. The cover 80 has an outer spherical surface with any selected dimple pattern, as in the previous embodiments, and an inner surface with an indented channel into which band 78 extends, with a thinner area 82 around raised band 78. Band 78 has a rounded, convex outer end with the opposing recess in cover 80 having a concave inner end.

FIG. 10 illustrates one example of the two layer core of ball 41 (Design "D1") of FIG. 9 with the outer cover removed, showing the outer surface of mantle layer 76 over the inner core 20. The inner core in this case has a radius of 0.74 inches, and the outer core has a radius ranging from 0.79 to 0.82 inches. The 0.82 radius occurs on the portion of the core that is essentially a band 78 of material surrounding the core. The height of the band 78 is around 0.03 inches. The other portion 83 of the outer core has a radius of 0.79 inches uniformly surrounding the rest of the core.

Figure 11:
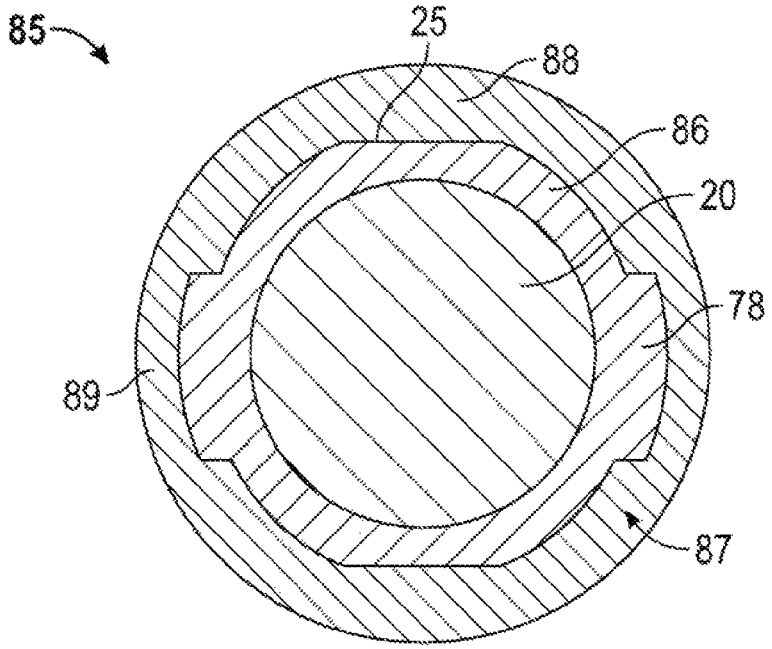
FIG. 11 is a cross sectional view through the poles of an eighth embodiment of a golf ball with a modified non-spherical core.

FIG. 11 illustrates another embodiment of a golf ball 85 (design "E1") that is essentially a combination of Design "D1" and Design "A1", having both a raised band 78 on mantle 86 at the equator, as in the embodiment of FIGS. 9 and 10 (Design "D1") and opposite flattened areas 25 in the opposite polar regions, as in the embodiment of FIGS. 1A to 2 (Design "A1"). In this embodiment, the mantle is thicker in the equatorial region than in the polar region. The outer cover 87 has a complementary inner surface shape and an outer spherical surface, resulting in corresponding thicker areas 88 at the polar region and thinner areas 89 in the equatorial region.

Figure 12:
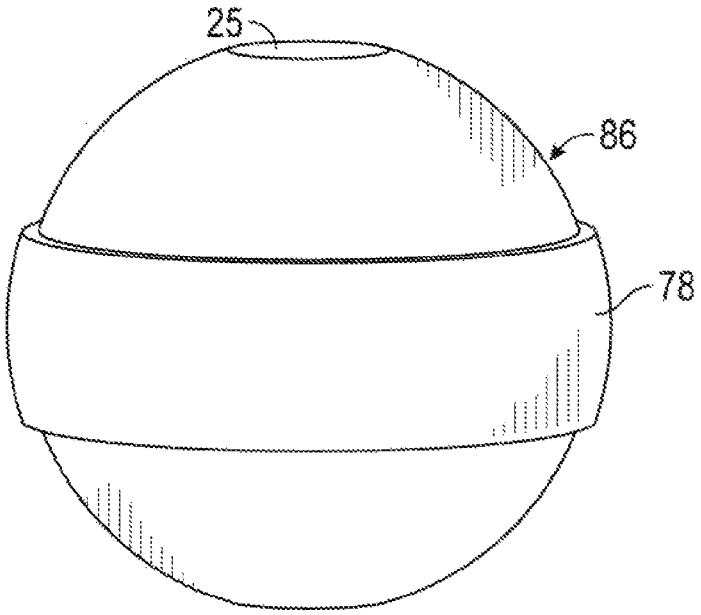
FIG. 12 is a front perspective view of the core of the golf ball of FIG. 11.

FIG. 12 illustrates one example of the two layer core of ball 85 (Design "E1") of FIG. 11 with the outer cover removed, showing the outer core (mantle) 87 over the inner core 20. The inner core 20 in this example has a radius of 0.74 inches, and the outer core has a radius ranging from 0.79 to 0.82 inches. The 0.82 radius occurs on the portion of the core that is essentially a band 78 of material surrounding the core. The other portion of the outer core has a radius of 0.79 inches except on the two opposite sides where the core has two disk shaped portions removed in the same fashion as Design "A1", producing flattened areas 25. As with Design "A1", the radius at the center of each of these disk areas is 0.76 inches and rises to 0.79 inches at the edges of the disks.

In the above embodiments, the mantle density or specific gravity may be greater than the cover layer density, but that does not have to be the case in all embodiments. The cover density may also be higher than the mantle density in the above embodiments, and this structure still results in a MOI differential. As long as there is a difference in the core and mantle densities in any of designs A1 to E1 of FIGS. 1A to 12, the balls display an MOI differential. Other examples of balls that would exhibit a desired MOI differential are described below, and include balls with two or more raised bands encircling the core, with the bands being parallel or not coplanar but still the resulting ball would have a center of gravity that corresponded closely or exactly to the center of the ball. The multiple variations of "D1" and "E1" designs could also be combined with one or more of the "A1", "B1" or "C1" designs as well as symmetrical or asymmetrical dimple patterns so as to produce a ball with a desirable MOI differential.

One consideration when having more than one band or recess in a core, mantle or cover is that the shape would be easier to injection mold and then remove from the mold if there were no undercut portions of the shape such that when the part was removed from the mold that it was caught on a protruding part of the mold that was closer to the parting line of the mold. The dimensions for some specific examples of Designs "A1" through "E1" are provided below. There could be many other examples, with an almost infinite combination of dimensions and the examples discussed above are just a few simple designs selected for illustration of the invention and some of its various aspects.

Table 1 below shows the dimensions of a 1.68" outer diameter golf ball of embodiments A1 through E1 (labeled A1, B1 . . . E1, respectively. In Table 1 the outer core is referred to as the "mantle". The numbers in Table 1 are expressed in "inches". For these particular examples, the width of the raised band for the mantle in ball designs D1 and E1 is 0.50 inches and the width of the flat area for the mantle on ball design B1 is 0.50 inches.

TABLE 1

| Ball Design | cover thickness in thinnest area | cover thickness in thickest area | mantle radius at thinnest location | mantle radius at thickest location | cover's outer radius | mantle thickness in thinnest area | mantle thickness in thick area | spherical inner core's outer radius | cover and mantle total thickness at thinnest point of cover | cover and mantle total thickness at thickest point of cover |
|---|---|---|---|---|---|---|---|---|---|---|
| A1 | 0.050 | 0.080 | 0.760 | 0.790 | 0.84 | 0.020 | 0.050 | 0.74 | 0.100 | 0.100 |
| B1 | 0.050 | 0.080 | 0.760 | 0.790 | 0.84 | 0.020 | 0.050 | 0.74 | 0.100 | 0.100 |
| C1 | 0.050 | 0.080 | 0.760 | 0.790 | 0.84 | 0.020 | 0.050 | 0.74 | 0.100 | 0.100 |
| D1 | 0.020 | 0.050 | 0.790 | 0.820 | 0.84 | 0.050 | 0.080 | 0.74 | 0.100 | 0.100 |
| E1 | 0.020 | 0.080 | 0.760 | 0.820 | 0.84 | 0.02 | 0.08 | 0.74 | 0.100 | 0.100 |

Tables 2 and 3 below provide the differential MOI data between the x, y and z spin axes for a combination of different specific gravity materials used with designs A1-E1. Any combination of specific gravities of materials could be used and this would in turn change the resulting MOI differential for the ball. It may be higher or lower than what is shown below.

TABLE 2

MOI Differential results for a ball without dimples.

| | Density, g/cm^3 | Mass, g | Volume, cm^3 | Ix, g cm^2 | Iy, g cm^2 | Iz, g cm^2 | Ix vs Iz |
|---|---|---|---|---|---|---|---|
| A-1 | | | | | | | |
| core | 1.150 | 31.988 | 27.815 | 45.2036626 | 45.2036626 | 45.2036626 | 0.000% |
| mantle | 1.200 | 7.147 | 5.956 | 17.9032281 | 17.9032323 | 18.2307139 | −1.813% |
| cover | 1.000 | 6.913 | 6.913 | 19.8552703 | 19.8552597 | 19.5823628 | 1.384% |
| sum | | 46.048 | 40.684 | 82.9621610 | 82.9621546 | 83.0167393 | −0.06577% |
| B-1 | | | | | | | |
| core | 1.150 | 31.988 | 27.815 | 45.2036626 | 45.2036626 | 45.2036626 | 0.000% |
| mantle | 1.200 | 6.407 | 5.340 | 16.6013852 | 16.6013852 | 15.0624696 | 9.720% |
| cover | 1.000 | 7.529 | 7.529 | 20.9401340 | 20.9401372 | 22.2225662 | −5.942% |
| sum | | 45.925 | 40.684 | 82.7451819 | 82.7451851 | 82.4886984 | 0.31045% |
| C-1 | | | | | | | |
| core | 1.150 | 31.988 | 27.815 | 45.2036626 | 45.2036626 | 45.2036626 | 0.000% |
| mantle | 1.200 | 4.207 | 3.506 | 11.1097041 | 11.1097041 | 8.8554597 | 22.582% |
| cover | 1.000 | 9.363 | 9.363 | 25.5165339 | 25.4934977 | 27.3950744 | −7.101% |
| sum | | 45.558 | 40.684 | 81.8299006 | 81.8068645 | 81.4541968 | 0.46018% |
| D-1 | | | | | | | |
| core | 1.150 | 31.988 | 27.815 | 45.2036626 | 45.2036626 | 45.2036626 | 0.000% |
| mantle | 1.200 | 8.725 | 7.271 | 21.4594972 | 21.4594993 | 24.2785243 | −12.327% |
| cover | 1.000 | 5.598 | 5.598 | 16.8917074 | 16.8917074 | 14.5425197 | 14.947% |
| sum | | 46.311 | 40.684 | 83.5548672 | 83.5548693 | 84.0247067 | −0.56074% |
| E-1 | | | | | | | |
| core | 1.150 | 31.988 | 27.815 | 45.2036626 | 45.2036626 | 45.2036626 | 0.000% |
| mantle | 1.200 | 8.639 | 7.199 | 21.1233135 | 21.1233135 | 24.2698234 | −13.863% |
| cover | 1.000 | 5.670 | 5.670 | 17.1718622 | 17.3621632 | 14.5497712 | 16.532% |
| sum | | 46.296 | 40.684 | 83.4988384 | 83.6891394 | 84.0232572 | −0.62609% |

TABLE 3

MOI Differential results for a ball with dimples.
MOI Calcs w/accounting for dimple volumes
weight of dimples in cover 0.4 grams

| | material specific gravity, g/cc | weight w/o dimples, g | weight with dimples, g | Volume without dimples, cm^3 | Volume with Dimples, cm^3 | Ix, g cm^2 | Iy, g cm^2 | Iz, g cm^2 | Ix vs Iz |
|---|---|---|---|---|---|---|---|---|---|
| A-1 | | | | | | | | | |
| core | 1.150 | 31.99 | 31.99 | 27.82 | 27.82 | 45.20366 | 45.20366 | 45.20366 | 0.0000% |
| mantle | 1.200 | 7.15 | 7.15 | 5.96 | 5.96 | 17.90323 | 17.90323 | 18.23071 | −1.8126% |
| cover | 1.000 | 6.91 | 6.51 | 6.91 | 6.51 | 18.70648 | 18.70647 | 18.44937 | 1.3840% |
| ball | | 46.05 | 45.65 | 40.68 | 40.28 | 81.81338 | 81.81337 | 81.88374 | −0.0860% |

TABLE 3-continued

MOI Differential results for a ball with dimples.
MOI Calcs w/accounting for dimple volumes
weight of dimples in cover 0.4 grams

| | material specific gravity, g/cc | weight w/o dimples, g | weight with dimples, g | Volume without dimples, cm^3 | Volume with Dimples, cm^3 | Ix, g cm^2 | Iy, g cm^2 | Iz, g cm^2 | Ix vs Iz |
|---|---|---|---|---|---|---|---|---|---|
| B-1 | | | | | | | | | |
| core | 1.150 | 31.99 | 31.99 | 27.82 | 27.82 | 45.20366 | 45.20366 | 45.20366 | 0.0000% |
| mantle | 1.200 | 6.41 | 6.41 | 5.34 | 5.34 | 16.60139 | 16.60139 | 15.06247 | 9.7203% |
| cover | 1.000 | 7.53 | 7.13 | 7.53 | 7.13 | 19.82770 | 19.82770 | 21.04200 | −5.9423% |
| ball | | 45.92 | 45.52 | 40.68 | 40.28 | 81.63275 | 81.63275 | 81.30814 | 0.3984% |
| C-1 | | | | | | | | | |
| core | 1.150 | 31.99 | 31.99 | 27.82 | 27.82 | 45.20366 | 45.20366 | 45.20366 | 0.0000% |
| mantle | 1.200 | 4.21 | 4.21 | 3.51 | 3.51 | 11.10970 | 11.10970 | 8.85546 | 22.5818% |
| cover | 1.000 | 9.36 | 8.96 | 9.36 | 8.96 | 24.42646 | 24.40441 | 26.22475 | −7.1007% |
| ball | | 45.56 | 45.16 | 40.68 | 40.28 | 80.73982 | 80.71777 | 80.28387 | 0.5663% |
| D-1 | | | | | | | | | |
| core | 1.000 | 27.82 | 27.82 | 27.82 | 27.82 | 39.30753 | 39.30753 | 39.30753 | 0.0000% |
| mantle | 1.600 | 11.63 | 11.63 | 7.27 | 7.27 | 28.61266 | 28.61267 | 32.37137 | −12.3268% |
| cover | 1.000 | 5.60 | 5.20 | 5.60 | 5.20 | 15.68471 | 15.68471 | 13.50338 | 14.9467% |
| ball | | 45.05 | 44.65 | 40.68 | 40.28 | 83.60491 | 83.60491 | 85.18228 | −1.8691% |
| E-1 | | | | | | | | | |
| core | 1.040 | 28.93 | 28.93 | 27.82 | 27.82 | 40.87983 | 40.87983 | 40.87983 | 0.0000% |
| mantle | 1.600 | 11.53 | 11.53 | 7.21 | 7.21 | 28.16442 | 28.16442 | 32.35976 | −13.8634% |
| cover | 1.000 | 5.67 | 5.27 | 5.67 | 5.27 | 15.96049 | 16.13736 | 13.52337 | 16.5319% |
| ball | | 46.13 | 45.73 | 40.69 | 40.29 | 85.00474 | 85.18162 | 86.76297 | −2.0472% |

Tables 2 and 3 above provide the MOI Differential for Designs A1-E1. The MOI for rotation about the x and y axes are the same, but the MOI for rotation about the z axis is different. The actual MOI differential for the entire ball design is given in the far right column of the last row for each ball design. The far right column is labeled "Ix vs Iz". This is the MOI Differential defined as the MOI percent difference between the ball rotating around the X-axis versus rotating around the Z-axis. Whether the value is positive or negative does not matter, this is just a matter of which axis MOI value was subtracted from the other. What matters is the absolute value of the "Ix vs Iz" value. For example, E-1 design has almost 10× the Moment of Inertia Differential (MOI differential) as A-1 design. The formula for calculating the MOI differential is as follows:

$$\text{Moment of Inertia Differential}=(\text{MOI } X\text{-axis}-\text{MOI } Z\text{-axis})/((\text{MOI } X\text{-axis}+\text{MOI } Z\text{-Axis})/2).$$

Figure 13:
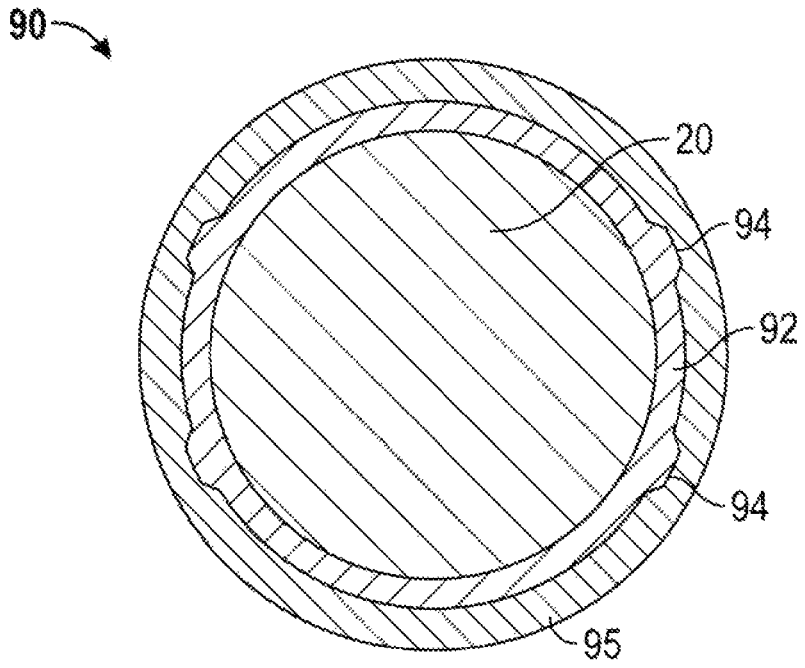
FIG. 13 is a cross-sectional view through the poles of a golf ball according to another embodiment.
Figure 14:
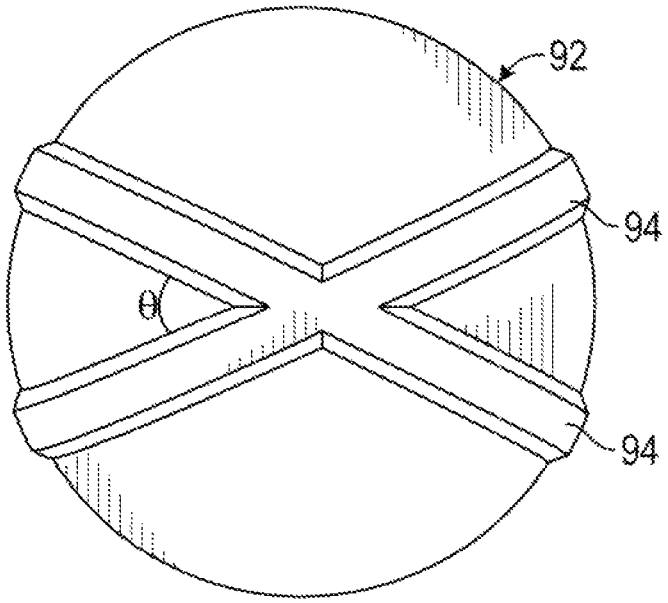
FIG. 14 is a front elevation view of the core of the golf ball of FIG. 13.

FIGS. 13 and 14 illustrate another embodiment of a golf ball 90 (design 1B) which has a spherical inner core 20 as in some of the previous embodiments, an outer core or mantle 92 which has two raised bands 94 encircling the core and crossing over in an X pattern at a non-perpendicular angle, and an outer cover layer 95 over the mantle layer 92 having a complementary inner surface shape with cross over channels. FIG. 14 illustrates the core with the cover layer removed. In this embodiment, the bands cross over at an angle θ of around 30 to 40 degrees, but other cross over angles may be used in other embodiments.

Figure 15:
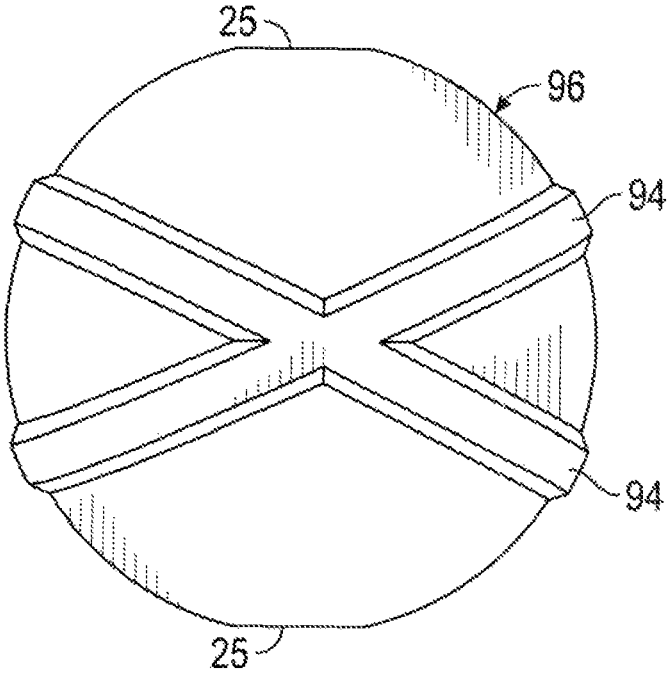
FIG. 15 is a front elevation view similar to FIG. 14 but illustrating a modified core.

FIG. 15 illustrates a modified core 96 (design 1A) which may be used in place of the core of FIG. 13 and is a variation of the core of FIGS. 13 and 14 combined with the core design of FIGS. 1A to 2, where flattened areas 25 are provided on the mantle layer at the poles. The core is otherwise identical to that of FIGS. 13 and 14 and like reference numbers are used as appropriate.

Figure 16:
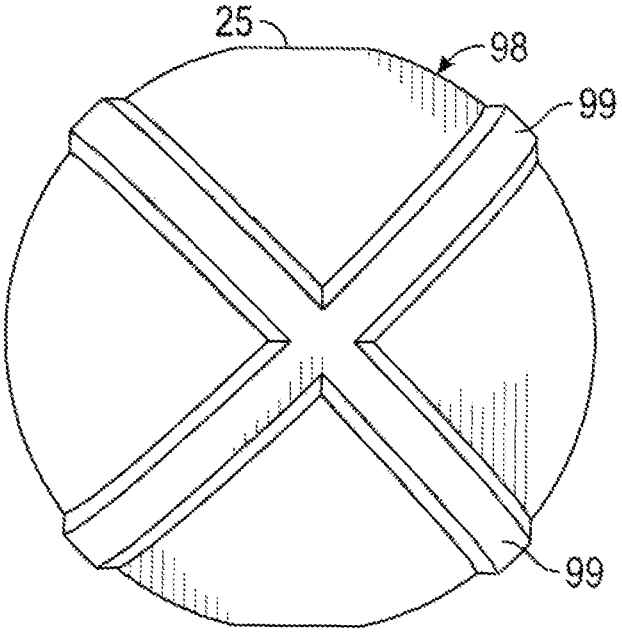
FIG. 16 is a front elevation view similar to FIGS. 14 and 15 but illustrating another modified core.

FIG. 16 illustrates another modified core 98 (design 1C) which is similar to that of FIG. 14 with flattened areas 25 at the poles, but in this case the two bands 99 cross over at a larger angle of around 90 degrees. The bands may alternatively be designed as in FIG. 14.

Figure 17:
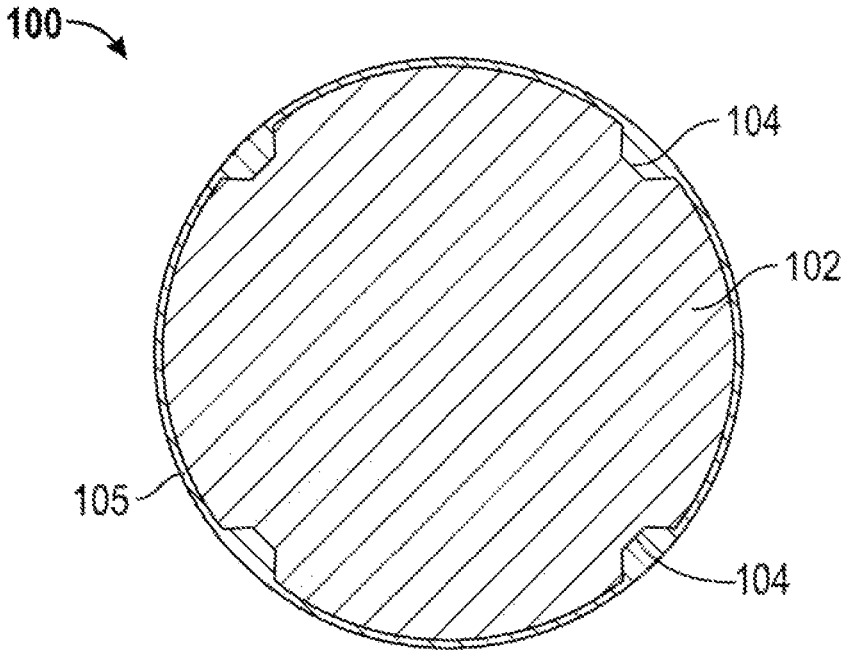
FIG. 17 is a cross sectional view through the poles of another embodiment of a golf ball with a modified non-spherical core.
Figure 18:
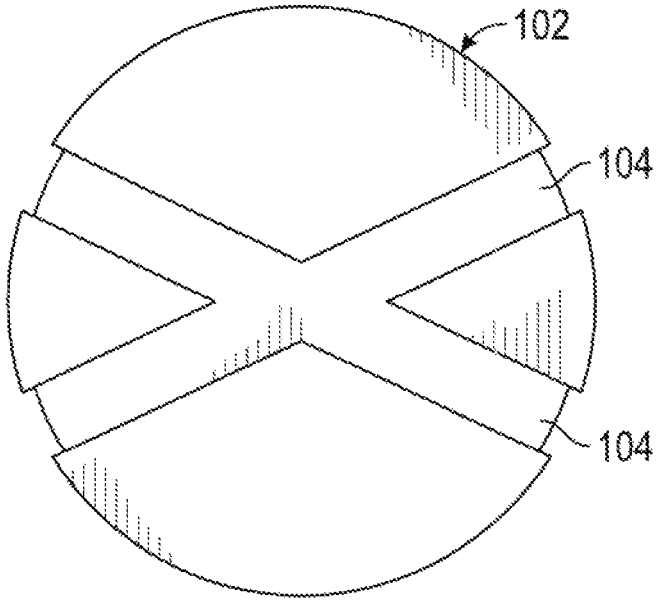
FIG. 18 is a front elevation view of the core of the golf ball of FIG. 17.

FIGS. 17 and 18 illustrate another embodiment of a golf ball 100 (design 2A) which has a core 102 which has two indented channels or grooves 104 where core material is removed and which cross over in an X pattern in a similar manner to the raised bands of FIGS. 13 and 14. An outer cover layer 105 with a spherical outer surface extends over mantle 102, and has portions 106 extending into the grooves or channels on the outer surface of the mantle. FIG. 18 illustrates core 102 with the outer cover removed. The cross over angle may be similar to that of FIGS. 13 and 14 or may be larger as in FIG. 16. FIG. 17 is a modified version of design 2A in that it shows the case of the channels in the core have sloped sides, as opposed to FIG. 18 where the sides of the channel are perpendicular to the base of the channel. The design 2A data in Tables 8-16 is for the case of the channels having perpendicular sides.

Figure 19:
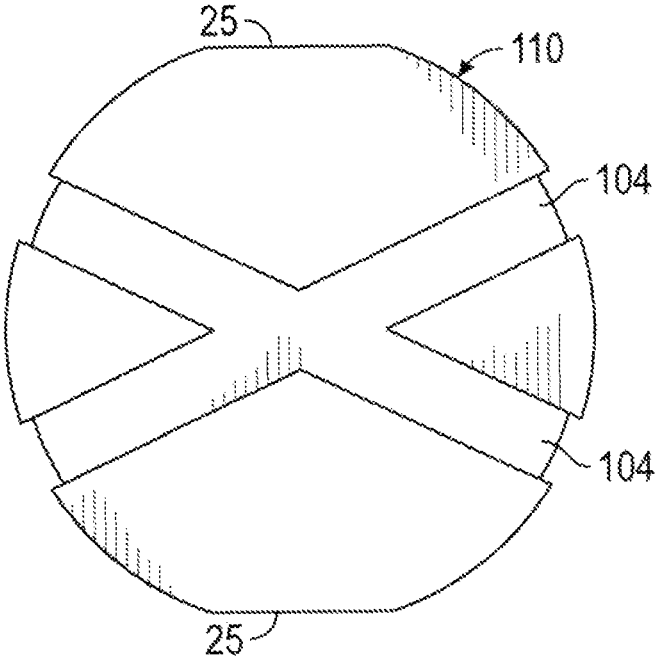
FIG. 19 is a front elevation view similar to FIG. 18 but with a modified core.

FIG. 19 illustrates a modified core 110 (design 2B) which may be used in place of the core of FIGS. 17 and 18. In this case the core of FIGS. 17 and 18 is combined with the core design of FIGS. 1A to 2, with flattened areas 25 at the opposite polar regions of the ball.

In the embodiments of FIGS. 17 to 19, the radius of core 102 is 0.740 inches. Although the core is one piece in the illustrated embodiment, it may comprise an inner core and mantle as in the previous embodiments, with the grooves or channels on the outer surface of the mantle layer.

In all of the embodiments of FIGS. 13 to 19, the center of gravity or cg is still in the center of the ball.

Figure 20:
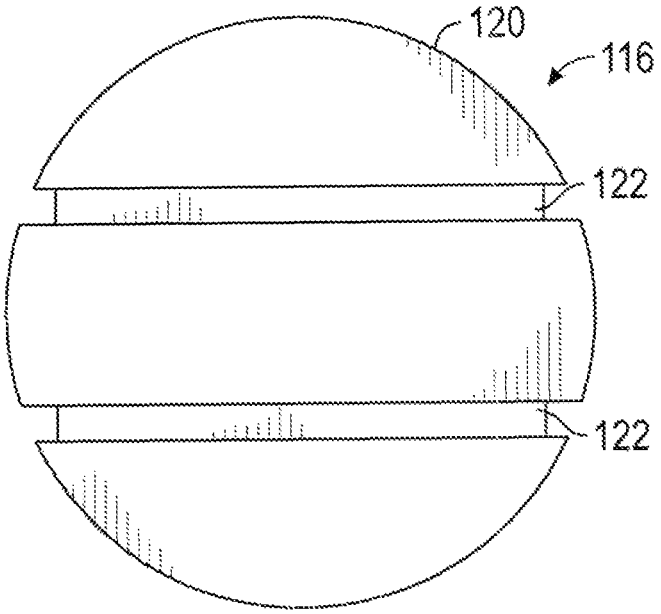
FIG. 20 is a front elevation view similar to FIGS. 18 and 19 but illustrating a modified core.
Figure 21:
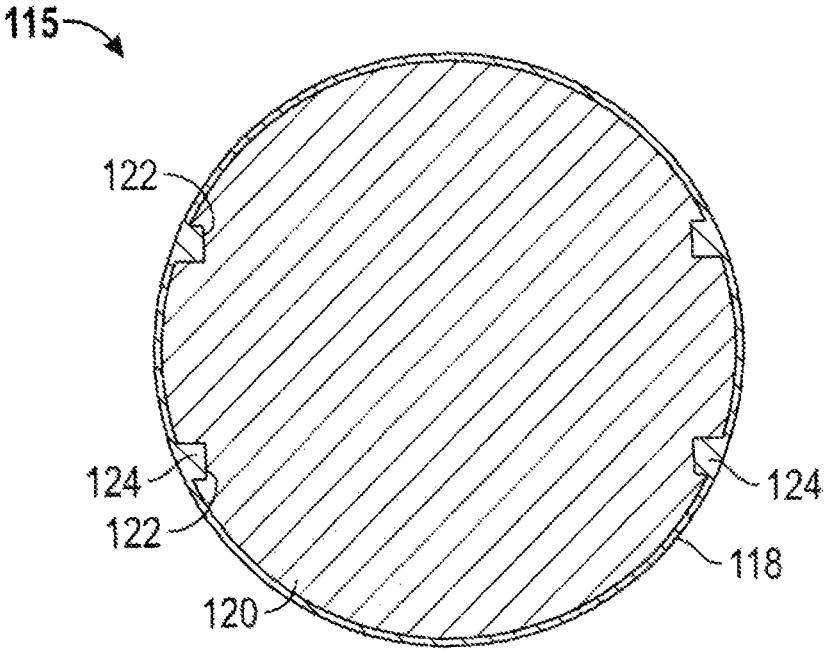
FIG. 21 is a cross-sectional view of a golf ball with the core of FIG. 20.

FIGS. 20 and 21 illustrate another embodiment of a golf ball 115 (design 4A) which has a core 116 and a cover 118. FIG. 20 illustrates the core 116 with the cover removed. As seen in FIGS. 20 and 21, the outer surface of core 116 has two parallel channels or recesses 122 extending in circular paths around the outside of core 116. As illustrated in FIG. 21, cover material 124 extends into each recess to form thickened regions of the cover. In other embodiments, the channels 122 may be non-parallel and extend at a slight angle to one another, or may be non-straight (wavy). In one example of ball 115, the core radius was 0.820, the separation between channels 122 was 0.50 inches, and the depth and width of each channel were both around 0.10 inches.

Figure 22:
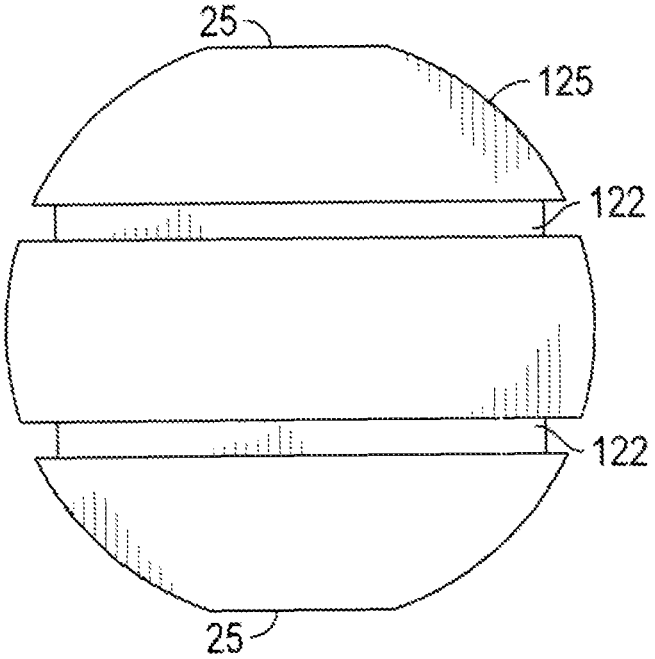
FIG. 22 is a front elevation view of a core similar to FIG. 20 but with flattened areas a the poles.

FIG. 22 illustrates a modified core 125 (design 4D) which may replace core 116 of FIGS. 20 and 21. Core 125 combines the flattened core end areas 25 of the first embodiment (Design A) with the parallel channels 122 encircling the core in design 4A, and the core and channels in FIG. 22 are of similar dimensions to those of FIGS. 20 and 21.

Figure 23:
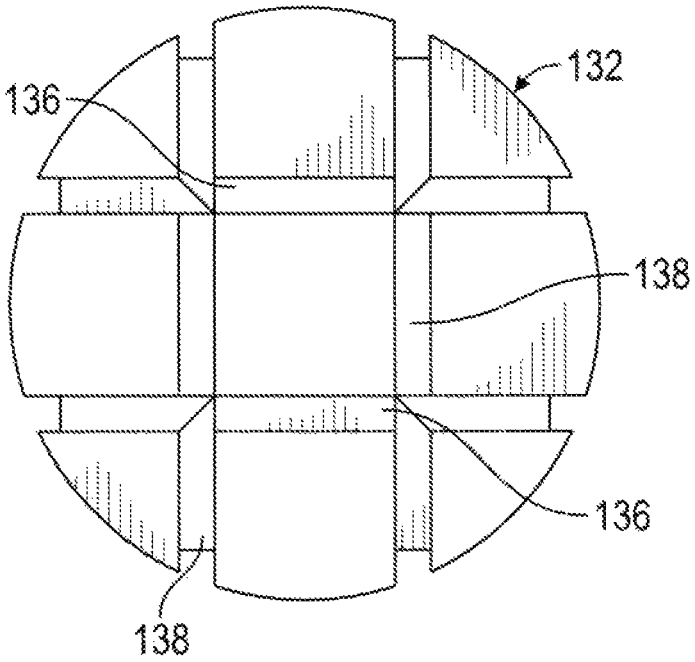
FIG. 23 is a front elevation view of the non-spherical core of another embodiment of a golf ball.
Figure 24:
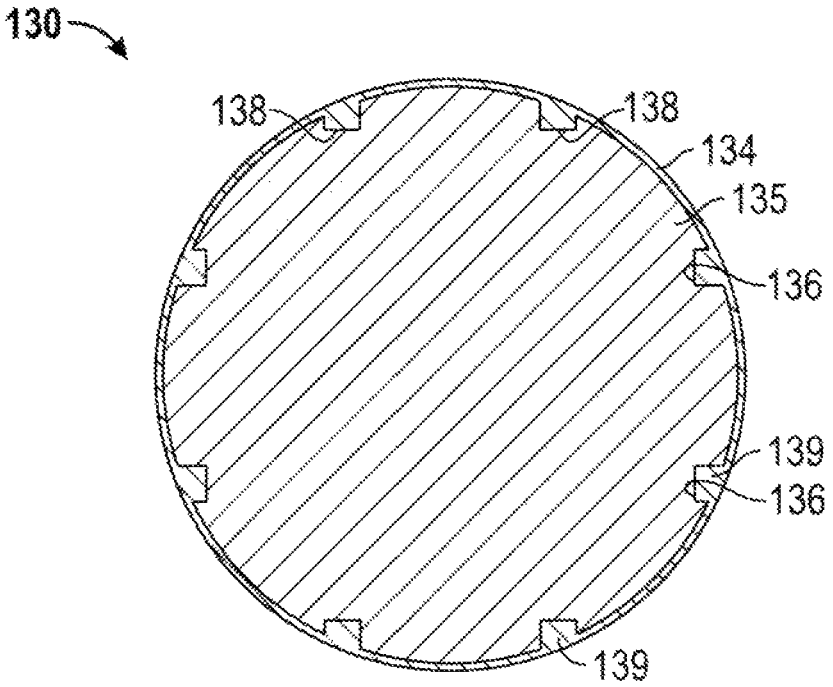
FIG. 24 is a cross-sectional view of a golf ball incorporating the core of FIG. 23.

FIGS. 23 and 24 illustrate another embodiment of a golf ball 130 (design 4C) which has a core 135 and cover 134, with FIG. 23 illustrating the core with the cover removed. As best seen in FIG. 23, the outer surface 132 of core 135 has a first pair of parallel channels or recesses 136 positioned as in the embodiment of FIGS. 20 and 21, and a second pair of parallel channels or recesses 138 extending perpendicular to recesses 136 and crossing over the recesses 136. As in design 4A and 4D, cover material 139 extends into all of the channels 136, 138. In the embodiments of FIGS. 14 to 24, the raised bands or grooves can also be made thinner or less deep or less high or have tapered, non-perpendicular side walls. These modifications may make parts of the ball easier to injection or compression mold and then remove from the mold. The grooves do not have to be molded into the structure, they can also be cut out as a post-molding step. The raised bands could also be cut out in a post-molding step if the mantle or core is molded at a larger diameter to accommodate the height of the bands. The cover or adjacent outer layer can then be injection molded around the mantle or core.

Figure 30:
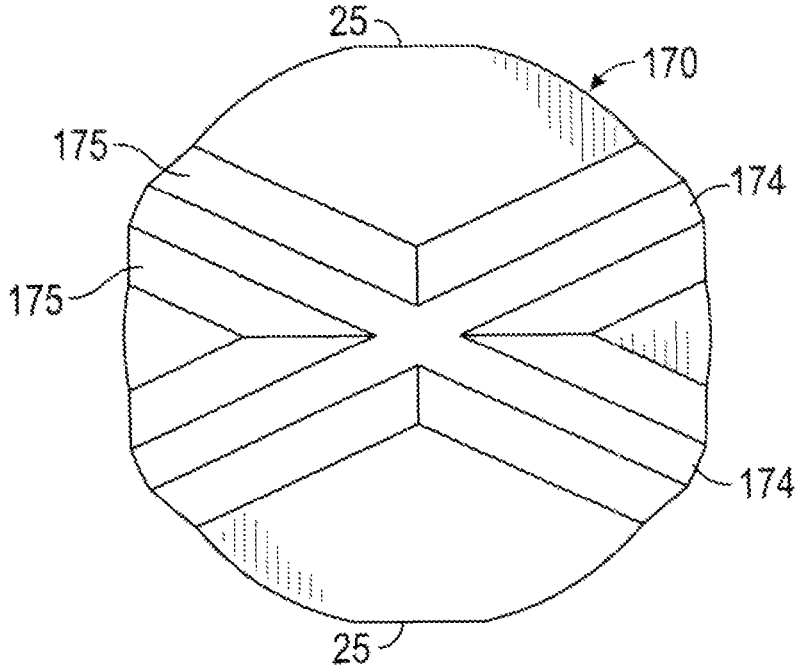
FIG. 30 is a front elevation view similar to FIGS. 14 and 15 but illustrating a modified core.

FIG. 30 illustrates an embodiment of a modified core (or mantle layer) 170 which has wider raised bands 174. In this core, the raised bands 174 are designed to provide an MOI differential between different axes, yet be easily removed from a mold. The core of FIG. 30 has a spherical radius (areas without bands) of 0.785 inches, and the distance from the center of the ball to a flattened area is around 0.765 inches (i.e. a thickness of about 0.020 inches of material is removed to form the flattened areas 25). The width of the top portion of the wide band is 0.122 inches, and the total width of the band including the opposite tapered sides 175 of the band is around 0.40 inches. The thickness of the band at the thickest point is 0.035 inches, and the distance from the center of the ball is around 0.820 inches at the thickest point. The width of the top portion of the band and maximum thickness is the same for the bands shown on the mantles in FIGS. 13-16. However, in the case of FIGS. 13-16, the widest part of the band is only 0.20 inches, as compared to 0.40 inches in this embodiment. The opposite sides 175 of the band in FIG. 30 are wider than in the embodiments of FIGS. 14 to 24 and tapered at a shallow angle, to make the core easier to demold. The total width of each band is around 0.04 inches. Any of the bands of FIGS. 13 to 24 may have bands or grooves of shape and dimensions similar to bands 174 of FIG. 30.

The density, mass, volume and MOI values for a ball made with the wide X-band mantle or outer core layer 170 of FIG. 30 and corresponding cover and solid core (similar to the cover and core in FIG. 13) are given in Table F1 below:

TABLE F1

MOI calculations for ball with core of FIG. 30

| Wide X-Band | Density, g/cm^3 | Mass, g | Volume, cm^3 | Ix, g cm^2 | Iy, g cm^2 | Iz, g cm^2 | Ix vs Iz |
|---|---|---|---|---|---|---|---|
| core | 1.150 | 31.988 | 27.815 | 45.2036626 | 45.2036626 | 45.2036626 | 0.000% |
| mantle | 1.200 | 7.989 | 6.657 | 19.6718063 | 19.5247132 | 21.9639651 | −11.011% |
| cover | 1.000 | 6.212 | 6.212 | 18.3814513 | 18.5040295 | 16.4713198 | 10.961% |
| sum | | 46.188 | 40.684 | 83.2569203 | 83.2324053 | 83.6389475 | −0.45780% |

In the embodiments of FIGS. 20 to 24, the golf ball is formed from two pieces, specifically core and a cover layer. However, the core may alternatively be two parts or pieces, comprising an inner core and mantle layer, with the grooves or channels in the outer surface of the mantle layer, or the cover layer 118 or 134 may instead be a mantle layer, with a cover layer of uniform thickness surrounding layer 118 or 134.

In the above embodiments, at least one inner layer or part of the ball is non-spherical and is asymmetrical in such a way that the MOI measured in three orthogonal axes is different for at least one of the axes. The non-spherical part in many of the above embodiments is described as an outer core layer or mantle, but could also be an inner cover layer of a two part cover. The design is such that at least one layer of the cover or core is non-uniform in thickness and non-uniform in radius. In one embodiment, the diameter of the entire core (including the inner core and any outer core layer) may be greater than 1.61 inches. At least one core or cover layer has a higher specific gravity than other layers. In one embodiment, the difference in the MOI of any two axes is less than about 3 gm $cm^2$.

Figure 25:
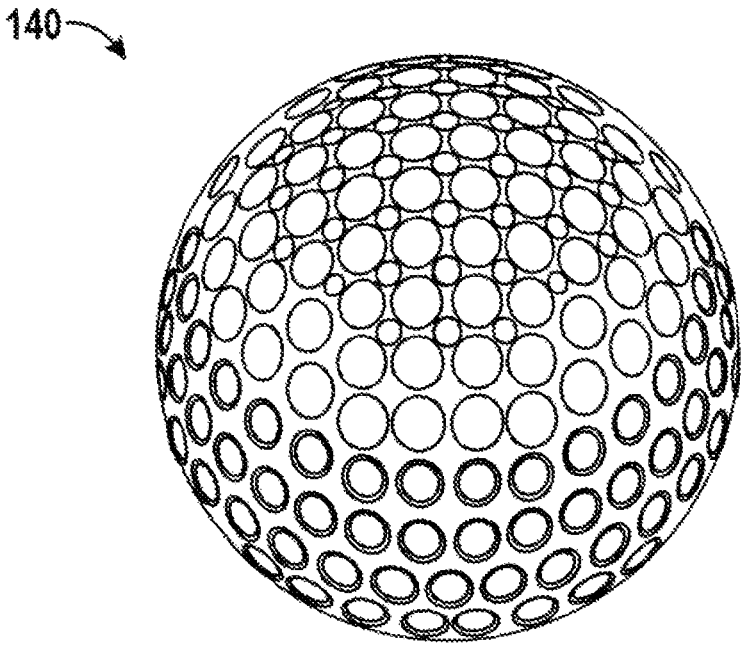
FIG. 25 is a perspective view of a golf ball with dimples which may have the core of any of the embodiments of FIGS. 1A to 24.
Figure 26:
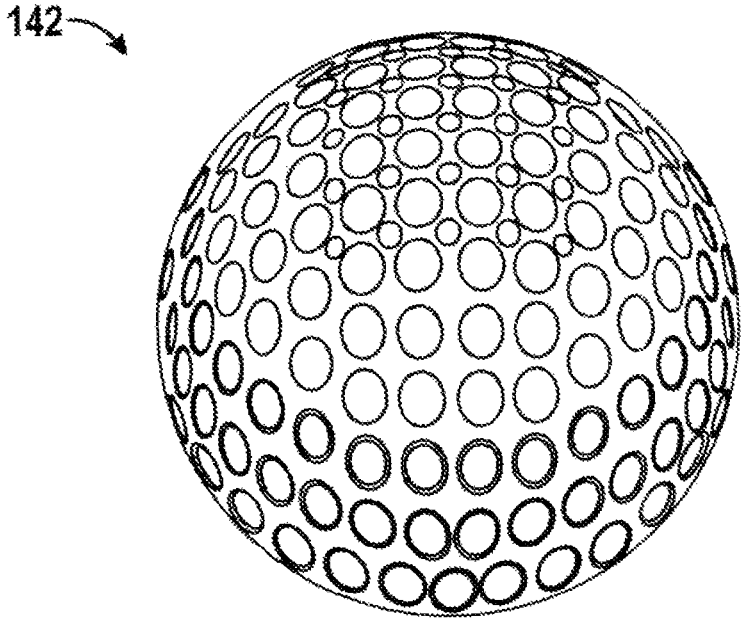
FIG. 26 is a perspective view of another embodiment of a golf ball with a different dimple pattern from FIG. 25, which may have the core of any of the embodiments of FIGS. 1A to 24.

As noted above, various types of symmetric or asymmetric dimple patterns may be provided on the outer cover of the golf balls described above. Golf balls with asymmetric dimple patterns are described in described in co-pending patent application Ser. No. 13/097,013 of the same Applicant filed on Aug. 28, 2011, the entire contents of which are incorporated herein by reference. Any of the dimple patterns described in that application may be combined with any of the golf balls described above with different MOI on at least two of the three perpendicular spin axes or principal axes. Two examples of dimple patterns described in application Ser. No. 13/097,013 are illustrated in FIGS. 25 and 26, with FIG. 25 illustrating a golf ball 140 with a dimple pattern which is the same as the 28-1 ball as described in application Ser. No. 13/097,013 and FIG. 26 illustrating a golf ball 140 with a dimple pattern which is the same as the a 25-1 ball as described in application Ser. No. 13/097,013. These dimple patterns (dimple positions, sizes, locations) are described in detail in application Ser. No. 13/097,013 referenced above, and are therefore not described in detail herein. Instead, reference is made to the description in application Ser. No. 13/097,013 for details of these dimple patterns. These dimple patterns or any other asymmetrical dimple patterns, such as dimple patterns 25-2, 25-3, 25-4, 28-2 and 28-3 described in application Ser. No. 13/097,013 referenced above, may be combined with the golf balls having different MOI on at least two axes to produce more variation in MOI.

Alternatively, the differential may result only from the asymmetry of the dimple pattern, as described application Ser. No. 13/097,013 referenced above. The MOI variations in several such balls are provided in Table 4 below.

TABLE 4

| Ball | Ix, lbs × inch^2 | Iy, lbs × inch^2 | Iz, lbs × inch^2 | Imax | Imin | MOI Delta = Imax − Imin | % (Imax − Imin)/ Imax | % MOI delta relative to Polara |
|---|---|---|---|---|---|---|---|---|
| Polara | 0.025848 | 0.025917 | 0.025919 | 0.025919 | 0.025848 | 0.0000703 | 0.271% | 0.0% |
| 2-9 | 0.025740 | 0.025741 | 0.025806 | 0.025806 | 0.025740 | 0.0000665 | 0.258% | −5.0% |
| 25-1 | 0.025712 | 0.025713 | 0.025800 | 0.025800 | 0.025712 | 0.0000880 | 0.341% | 25.7% |
| 25-2 | 0.02556791 | 0.02557031 | 0.02558386 | 0.0255839 | 0.0255679 | 1.595E−05 | 0.062% | −77.0% |
| 25-3 | 0.0255822 | 0.02558822 | 0.02559062 | 0.0255906 | 0.0255822 | 8.42E−06 | 0.033% | −87.9% |
| 25-4 | 0.02557818 | 0.02558058 | 0.02559721 | 0.0255972 | 0.0255782 | 1.903E−05 | 0.074% | −72.6% |
| 28-1 | 0.025638 | 0.025640 | 0.025764 | 0.025764 | 0.025638 | 0.0001254 | 0.487% | 79.5% |
| 28-2 | 0.025638 | 0.025640 | 0.025764 | 0.025764 | 0.025638 | 0.0001258 | 0.488% | 80.0% |
| 28-3 | 0.02568461 | 0.02568647 | 0.02577059 | 0.0257706 | 0.0256846 | 8.598E−05 | 0.334% | 23.0% |

With the original Polara™ golf ball dimple pattern (deep spherical dimples around the equator and shallow truncated dimples on the poles) as a standard, the MOI differences between each orientation of balls with different asymmetric dimple patterns are compared to the original Polara golf ball in addition to being compared to each other. In Table 4, the largest difference between any two orientations is called the "MOI Delta". In this case the MOI Delta and the previously defined MOI Differentials are different quantities because they are calculated differently. However, they both define a difference in MOI between one rotational axis and the other. And it is this difference, no matter how it is defined, which is important to understand in order to make balls which will perform straighter when hit with a slice or hook type golf swing.

In Table 4, the two columns to the right quantify the MOI Delta in terms of the maximum % difference in MOI between two orientations and the MOI Delta relative to the MOI Delta for the original Polara ball. Because the density value used to calculate the mass and MOI (using the solid works CAD program) was lower than the average density of a golf ball, the predicted weight and MOI for each ball are relative to each other, but not exactly the same as the actual MOI values of the golf balls that were made, robot tested and shown in Table 4. Generally a golf ball weighs about 45.5-45.9 g. Comparing the MOI values of all of the balls in Table 4 is quite instructive, in that it predicts the relative order of MOI difference between the different designs.

Design 25-1 of FIG. 26 is very similar to the dimple pattern on the new Polara Ultimate Straight golf balls and has three rows of shallow dimples around the ball's equator and deep spherical dimples (larger dimples) as well as smaller dimples at the polar region. The main difference between dimple patterns 28-1 of FIG. 25 and pattern 25-1 of FIG. 26 is that the 28-1 pattern has more weight removed from the polar regions than pattern 25-1, because the small dimples between the larger, deep dimples are larger in number and volume in dimple pattern 28-1. Dimple patterns 25-2, 25-3 and 25-4 as described in U.S. patent application Ser. No. 13/097,013 referenced above also have truncated dimples around the equatorial region but of larger diameter than those of patterns 25-1 and 28-1, so that more weight is removed around the equator, resulting in a smaller MOI difference between the PH and POP orientations. Dimple pattern 28-2 is nearly identical to 28-1 except that the seam that separates one hemisphere of the ball from the other is wider in pattern 28-2. Dimple pattern 28-3 has similar row of truncated dimples at the equatorial region but has a different dimple arrangement in the polar region, with small spherical dimples arranged together in an area around each pole, and larger, deep spherical dimples between the area of smaller dimples and the equatorial region.

Any of these dimple patterns may be used on the outer surface of any of the balls in the preceding embodiments.

Table 5 shows that a ball's MOI Delta does strongly influence the balls dispersion control. In general as the relative MOI Delta of each ball increases, for a slice shot the dispersion distance decreases. Balls 28-3, 25-1, 28-1 and 28-2 all have higher MOI deltas relative to the Polara, and they all have better dispersion control than the Polara. This is shown in Table 5 below.

TABLE 5

| Ball | Orientation | % MOI difference between orientations | Avg C-DISP, ft | Avg C-DIST, yds | Avg T-DISP, ft | Avg T-DIST, yds |
|---|---|---|---|---|---|---|
| 28-2 | PH | 0.488% | 9.6 | 180.6 | 7.3 | 201.0 |
| 28-1 | PH | 0.487% | −2.6 | 174.8 | −7.6 | 200.5 |
| TopFLite XL Straight | random | 0.000% | 66.5 | 189.3 | 80.6 | 200.4 |
| 25-1 | PH | 0.341% | 7.4 | 184.7 | 9.6 | 207.5 |
| 28-3 | PH | 0.334% | 16.3 | 191.8 | 23.5 | 211.8 |
| Polara | PFB | 0.271% | 29.7 | 196.6 | 38.0 | 214.6 |
| 2-9 | PH | 0.258% | 12.8 | 192.2 | 10.5 | 214.5 |
| 25-4 | PH | 0.074% | 56.0 | 185.4 | 71.0 | 197.3 |
| 25-2 | PH | 0.062% | 52.8 | 187.0 | 68.1 | 199.9 |
| 25-3 | PH | 0.033% | 63.4 | 188.0 | 75.1 | 197.9 |

Golf balls of the embodiments with asymmetrical dimple patterns described above exhibit lower aerodynamic lift properties in one orientation than in another. If these dimple patterns are provided on balls with core and cover layers constructed as described above in connection with the embodiments of FIGS. 1A to 24, the lower lift properties of dimple patterns like those above act to reinforce the slice and hook correcting MOI differential properties of the ball construction and thus help reduce the slice or hook even further as the ball is flying through the air. A symmetrical low-lift dimple pattern can also be added to the ball constructions of FIGS. 1A to 24 with differential MOI so that the lift characteristic helps the ball reduce hook and slice dispersion in the high MOI or any other orientation. With the asymmetrical dimple designs described above, such as those of FIGS. 25 and 26 for example, the ball is aligned so the horizontal axis is pointed at the golfer (PH=poles horizontal orientation) and as long as this horizontal axis does not represent the lowest of the MOI differential axis values (ideally the horizontal axis represents the highest MOI differential axis configuration) the ball will exhibit slice and hook correcting behavior. In this configuration the horizontal axis is also parallel to the ground and is orthogonal to the intended direction of travel. The horizontal axis in this configuration would also be essentially aligned perpendicular to the plane of the club face and is aligned horizontally pointing towards the golfer.

Any combination of symmetrical or asymmetrical dimple patterns, such as the dimple patterns of FIGS. 25 and 26 or any other dimple patterns described in U.S. patent application Ser. No. 13/097,013 referenced above, can also be combined with these designs or combination of designs. The dimple patterns could also be combined so that the MOI differentials caused by the ball construction, dimple patterns and specific gravities of layers all work together to give the maximum MOI differential or they could be oriented so that they did not maximize the ball's MOI differential but instead lowered the MOI differential of the ball because the maximum MOI axis of each part did not correspond to the same location.

Figure 27:
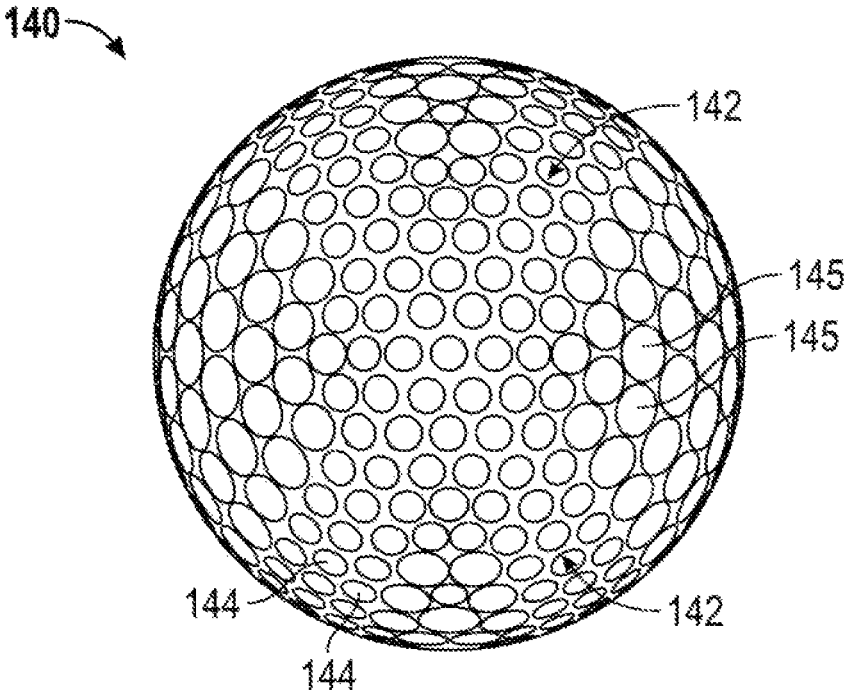
FIG. 27 is a perspective view of another embodiment of a golf ball with another different dimple pattern which may have the core of any of the embodiments of FIGS. 1A to 24.

FIG. 27 illustrates a ball 140 according to another embodiment which has a different, crossing dimple pattern. This ball has two bands 142 of smaller dimples 144 which cross over one another in a similar manner to the cross over channels on the core of the ball of FIG. 18. The remainder of the ball surface has larger dimples 145 of varying sizes. The smaller dimples 144 may also be of different sizes.

Figure 28:
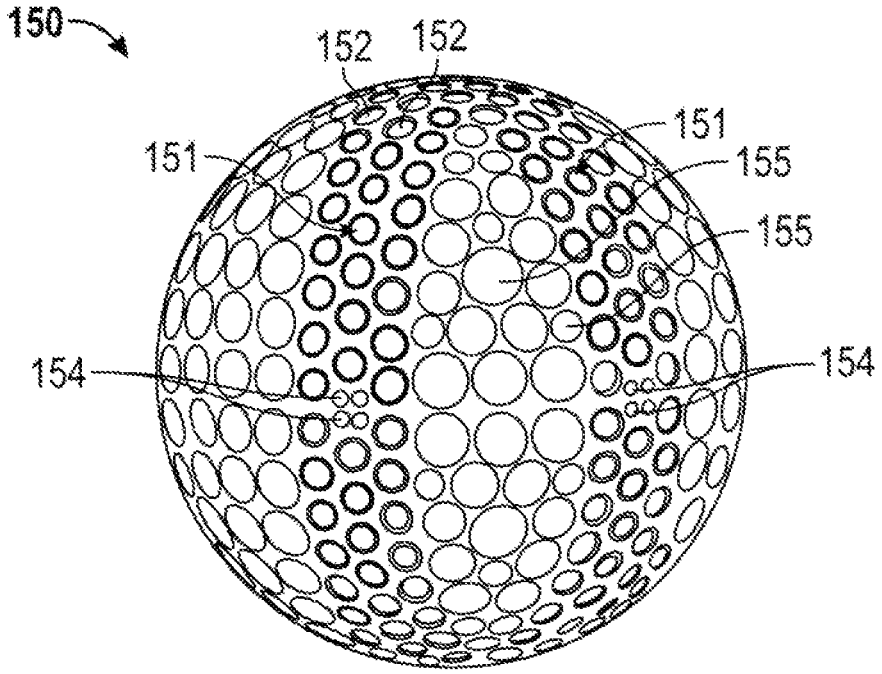
FIG. 28 is a perspective view of another embodiment of a golf ball with a different dimple pattern which may have the core of any of the embodiments of FIGS. 1A to 24.

FIG. 28 illustrates another ball 150 with a modified cross over dimple pattern similar to that of ball 140 but with the dimples in the cross over bands 151 including some truncated spherical dimples 152 and sets of four smaller dimples 154 at spaced locations in each band. Dimples 155 in the areas outside bands 151 are of varying sizes but the majority are larger than the dimples in bands 151.

Figure 29:
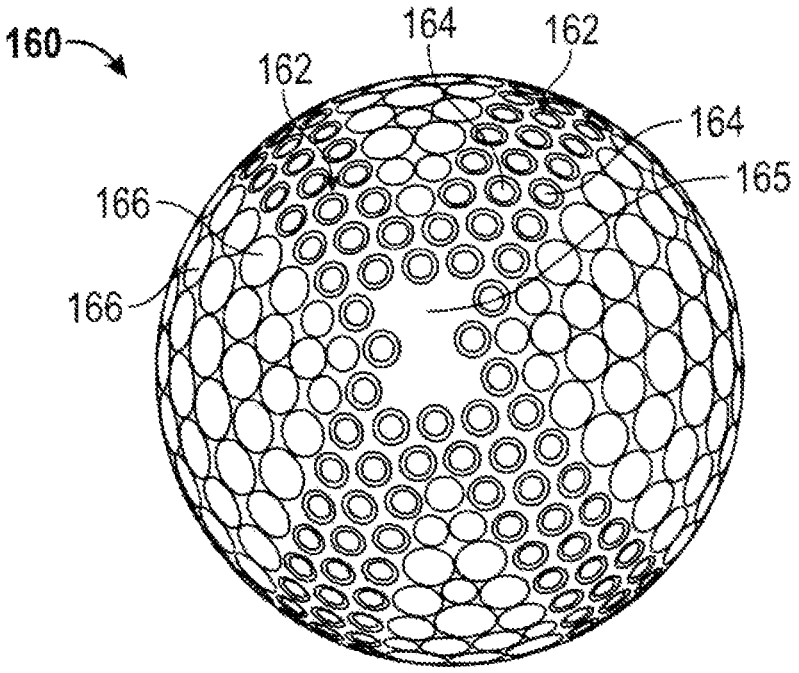
FIG. 29 is a perspective view of another embodiment of a golf ball with a different dimple pattern which may have the core of any of the embodiments of FIGS. 1A to 24.

FIG. 29 illustrates another embodiment of a golf ball 160 with a cross over dimple pattern similar to FIG. 27, but with two cross over bands 162 of spherical truncated dimples 164 and an open area 165 of no dimples at each cross over point. The remainder of the dimples in areas outside the cross-over bands 162 are spherical dimples 166 in a range of different sizes. This dimple pattern is referred to as dimple pattern 95-3 in the following description. The spherical truncated dimples are formed as described in co-pending patent applicaton Ser. No. 13/097,013 referenced above, the contents of which are incorporated herein by reference (see FIG. 9 of application Ser. No. 13/097,013 and corresponding description).

The dimple co-ordinates for one embodiment of dimple pattern 95-3 of FIG. 29 are shown in Table 6 below.

TABLE 6

Design parameters for dimple pattern 95-3.

| Dimple Location Coordinates | | Dimple | Dimple | Dimple |
|---|---|---|---|---|
| Phi | Theta | Radius, in | depth, in | shape |
| 21.8270 | 84.6792 | 0.0750 | 0.0080 | spherical |
| 32.3147 | 84.6792 | 0.0750 | 0.0080 | spherical |
| 42.7978 | 84.6792 | 0.0750 | 0.0080 | spherical |
| 137.2022 | 84.6792 | 0.0750 | 0.0080 | spherical |
| 147.6853 | 84.6792 | 0.0750 | 0.0080 | spherical |

TABLE 6-continued

Design parameters for dimple pattern 95-3.

| Dimple Location Coordinates | | Dimple | Dimple | Dimple |
|---|---|---|---|---|
| Phi | Theta | Radius, in | depth, in | shape |
| 158.1730 | 84.6792 | 0.0750 | 0.0080 | spherical |
| 201.8270 | 84.6792 | 0.0750 | 0.0080 | spherical |
| 212.3147 | 84.6792 | 0.0750 | 0.0080 | spherical |
| 222.7978 | 84.6792 | 0.0750 | 0.0080 | spherical |
| 317.2022 | 84.6792 | 0.0750 | 0.0080 | spherical |
| 327.6853 | 84.6792 | 0.0750 | 0.0080 | spherical |
| 338.1730 | 84.6792 | 0.0750 | 0.0080 | spherical |
| 11.1741 | 84.5082 | 0.0775 | 0.0085 | spherical |
| 168.8259 | 84.5082 | 0.0775 | 0.0085 | spherical |
| 191.1741 | 84.5082 | 0.0775 | 0.0085 | spherical |
| 348.8259 | 84.5082 | 0.0775 | 0.0085 | spherical |
| 0.0000 | 84.1660 | 0.0825 | 0.0085 | spherical |
| 180.0000 | 84.1660 | 0.0825 | 0.0085 | spherical |
| 18.8528 | 74.3007 | 0.0800 | 0.0080 | spherical |
| 161.1472 | 74.3007 | 0.0800 | 0.0080 | spherical |
| 198.8528 | 74.3007 | 0.0800 | 0.0080 | spherical |
| 341.1472 | 74.3007 | 0.0800 | 0.0080 | spherical |
| 42.1883 | 74.0879 | 0.0775 | 0.0080 | spherical |
| 137.8117 | 74.0879 | 0.0775 | 0.0080 | spherical |
| 222.1883 | 74.0879 | 0.0775 | 0.0080 | spherical |
| 317.8117 | 74.0879 | 0.0775 | 0.0080 | spherical |
| 30.4890 | 74.0478 | 0.0800 | 0.0080 | spherical |
| 149.5110 | 74.0478 | 0.0800 | 0.0080 | spherical |
| 210.4890 | 74.0478 | 0.0800 | 0.0080 | spherical |
| 329.5110 | 74.0478 | 0.0800 | 0.0080 | spherical |
| 6.5803 | 73.7747 | 0.0900 | 0.0085 | spherical |
| 173.4197 | 73.7747 | 0.0900 | 0.0085 | spherical |
| 186.5803 | 73.7747 | 0.0900 | 0.0085 | spherical |
| 353.4197 | 73.7747 | 0.0900 | 0.0085 | spherical |
| 14.2046 | 63.3087 | 0.0900 | 0.0080 | spherical |
| 165.7954 | 63.3087 | 0.0900 | 0.0080 | spherical |
| 194.2046 | 63.3087 | 0.0900 | 0.0080 | spherical |
| 345.7954 | 63.3087 | 0.0900 | 0.0080 | spherical |
| 40.4957 | 63.0753 | 0.0825 | 0.0080 | spherical |
| 139.5043 | 63.0753 | 0.0825 | 0.0080 | spherical |
| 220.4957 | 63.0753 | 0.0825 | 0.0080 | spherical |
| 319.5043 | 63.0753 | 0.0825 | 0.0080 | spherical |
| 27.6319 | 63.0681 | 0.0825 | 0.0080 | spherical |
| 152.3681 | 63.0681 | 0.0825 | 0.0080 | spherical |
| 207.6319 | 63.0681 | 0.0825 | 0.0080 | spherical |
| 332.3681 | 63.0681 | 0.0825 | 0.0080 | spherical |
| 0.0000 | 62.6719 | 0.0925 | 0.0085 | spherical |
| 180.0000 | 62.6719 | 0.0925 | 0.0085 | spherical |
| 37.7785 | 52.1889 | 0.0775 | 0.0080 | spherical |
| 142.2215 | 52.1889 | 0.0775 | 0.0080 | spherical |
| 217.7785 | 52.1889 | 0.0775 | 0.0080 | spherical |
| 322.2215 | 52.1889 | 0.0775 | 0.0080 | spherical |
| 23.4384 | 51.9772 | 0.0850 | 0.0080 | spherical |
| 156.5616 | 51.9772 | 0.0850 | 0.0080 | spherical |
| 203.4384 | 51.9772 | 0.0850 | 0.0080 | spherical |
| 336.5616 | 51.9772 | 0.0850 | 0.0080 | spherical |
| 7.9879 | 51.9242 | 0.0900 | 0.0080 | spherical |
| 172.0121 | 51.9242 | 0.0900 | 0.0080 | spherical |
| 187.9879 | 51.9242 | 0.0900 | 0.0080 | spherical |
| 352.0121 | 51.9242 | 0.0900 | 0.0080 | spherical |
| 16.7776 | 41.7657 | 0.0775 | 0.0080 | spherical |
| 163.2224 | 41.7657 | 0.0775 | 0.0080 | spherical |
| 196.7776 | 41.7657 | 0.0775 | 0.0080 | spherical |
| 343.2224 | 41.7657 | 0.0775 | 0.0080 | spherical |
| 33.2575 | 41.7337 | 0.0800 | 0.0080 | spherical |
| 146.7425 | 41.7337 | 0.0800 | 0.0080 | spherical |
| 213.2575 | 41.7337 | 0.0800 | 0.0080 | spherical |
| 326.7425 | 41.7337 | 0.0800 | 0.0080 | spherical |
| 0.0000 | 41.4315 | 0.0825 | 0.0080 | spherical |
| 180.0000 | 41.4315 | 0.0825 | 0.0080 | spherical |
| 9.5096 | 32.4648 | 0.0700 | 0.0080 | spherical |
| 170.4904 | 32.4648 | 0.0700 | 0.0080 | spherical |
| 189.5096 | 32.4648 | 0.0700 | 0.0080 | spherical |
| 350.4904 | 32.4648 | 0.0700 | 0.0080 | spherical |
| 27.9004 | 31.5681 | 0.0700 | 0.0080 | spherical |
| 152.0996 | 31.5681 | 0.0700 | 0.0080 | spherical |
| 207.9004 | 31.5681 | 0.0700 | 0.0080 | spherical |
| 332.0996 | 31.5681 | 0.0700 | 0.0080 | spherical |
| 0.0000 | 24.5882 | 0.0600 | 0.0080 | spherical |

TABLE 6-continued

Design parameters for dimple pattern 95-3.

| Dimple Location Coordinates | | Dimple | Dimple | Dimple |
|---|---|---|---|---|
| Phi | Theta | Radius, in | depth, in | shape |
| 180.0000 | 24.5882 | 0.0600 | 0.0080 | spherical |
| 19.4033 | 23.0874 | 0.0525 | 0.0080 | spherical |
| 160.5967 | 23.0874 | 0.0525 | 0.0080 | spherical |
| 199.4033 | 23.0874 | 0.0525 | 0.0080 | spherical |
| 340.5967 | 23.0874 | 0.0525 | 0.0080 | spherical |
| 0.0000 | 16.8793 | 0.0500 | 0.0080 | spherical |
| 180.0000 | 16.8793 | 0.0500 | 0.0080 | spherical |
| 75.8147 | 74.9004 | 0.0500 | 0.0050 | spherical |
| 104.1853 | 74.9004 | 0.0500 | 0.0050 | spherical |
| 255.8147 | 74.9004 | 0.0500 | 0.0050 | spherical |
| 284.1853 | 74.9004 | 0.0500 | 0.0050 | spherical |
| 84.0292 | 38.1323 | 0.0525 | 0.0050 | spherical |
| 90.0000 | 53.9939 | 0.0525 | 0.0050 | spherical |
| 95.9708 | 38.1323 | 0.0525 | 0.0050 | spherical |
| 264.0292 | 38.1323 | 0.0525 | 0.0050 | spherical |
| 270.0000 | 53.9939 | 0.0525 | 0.0050 | spherical |
| 275.9708 | 38.1323 | 0.0525 | 0.0050 | spherical |
| 90.0000 | 30.2529 | 0.0550 | 0.0050 | spherical |
| 270.0000 | 30.2529 | 0.0550 | 0.0050 | spherical |
| 78.1543 | 66.8061 | 0.0700 | 0.0050 | spherical |
| 101.8457 | 66.8061 | 0.0700 | 0.0050 | spherical |
| 258.1543 | 66.8061 | 0.0700 | 0.0050 | spherical |
| 281.8457 | 66.8061 | 0.0700 | 0.0050 | spherical |
| 79.8109 | 56.9863 | 0.0725 | 0.0050 | spherical |
| 84.6928 | 74.7269 | 0.0725 | 0.0050 | spherical |
| 95.3072 | 74.7269 | 0.0725 | 0.0050 | spherical |
| 100.1891 | 56.9863 | 0.0725 | 0.0050 | spherical |
| 259.8109 | 56.9863 | 0.0725 | 0.0050 | spherical |
| 264.6928 | 74.7269 | 0.0725 | 0.0050 | spherical |
| 275.3072 | 74.7269 | 0.0725 | 0.0050 | spherical |
| 280.1891 | 56.9863 | 0.0725 | 0.0050 | spherical |
| 82.8467 | 46.9968 | 0.0750 | 0.0050 | spherical |
| 97.1533 | 46.9968 | 0.0750 | 0.0050 | spherical |
| 262.8467 | 46.9968 | 0.0750 | 0.0050 | spherical |
| 277.1533 | 46.9968 | 0.0750 | 0.0050 | spherical |
| 90.0000 | 84.1660 | 0.0825 | 0.0050 | spherical |
| 270.0000 | 84.1660 | 0.0825 | 0.0050 | spherical |
| 78.3009 | 83.9948 | 0.0850 | 0.0050 | spherical |
| 101.6991 | 83.9948 | 0.0850 | 0.0050 | spherical |
| 258.3009 | 83.9948 | 0.0850 | 0.0050 | spherical |
| 281.6991 | 83.9948 | 0.0850 | 0.0050 | spherical |
| 90.0000 | 64.0023 | 0.0900 | 0.0050 | spherical |
| 270.0000 | 64.0023 | 0.0900 | 0.0050 | spherical |
| 0.0000 | 9.0005 | 0.0525 | 0.0039 | truncated |
| 30.0000 | 15.5797 | 0.0525 | 0.0039 | truncated |
| 40.1871 | 23.7627 | 0.0525 | 0.0039 | truncated |
| 45.3421 | 32.3801 | 0.0525 | 0.0039 | truncated |
| 48.2621 | 41.1300 | 0.0525 | 0.0039 | truncated |
| 49.9941 | 49.9212 | 0.0525 | 0.0039 | truncated |
| 50.9686 | 58.7736 | 0.0525 | 0.0039 | truncated |
| 51.5123 | 67.7222 | 0.0525 | 0.0039 | truncated |
| 51.9298 | 76.6289 | 0.0525 | 0.0039 | truncated |
| 52.3885 | 85.5337 | 0.0525 | 0.0039 | truncated |
| 60.0000 | 17.9044 | 0.0525 | 0.0039 | truncated |
| 60.0000 | 27.2199 | 0.0525 | 0.0039 | truncated |
| 60.0000 | 36.1155 | 0.0525 | 0.0039 | truncated |
| 60.0000 | 45.0000 | 0.0525 | 0.0039 | truncated |
| 60.0000 | 54.0000 | 0.0525 | 0.0039 | truncated |
| 60.0000 | 63.0000 | 0.0525 | 0.0039 | truncated |
| 60.0000 | 72.0000 | 0.0525 | 0.0039 | truncated |
| 60.0000 | 81.0000 | 0.0525 | 0.0039 | truncated |
| 67.8935 | 76.6701 | 0.0525 | 0.0039 | truncated |
| 68.1082 | 85.5337 | 0.0525 | 0.0039 | truncated |
| 68.1818 | 67.7570 | 0.0525 | 0.0039 | truncated |
| 68.9243 | 58.8870 | 0.0525 | 0.0039 | truncated |
| 70.2769 | 49.9570 | 0.0525 | 0.0039 | truncated |
| 71.9425 | 41.1058 | 0.0525 | 0.0039 | truncated |
| 74.5088 | 32.2228 | 0.0525 | 0.0039 | truncated |
| 78.9041 | 23.7143 | 0.0525 | 0.0039 | truncated |
| 90.0000 | 15.5797 | 0.0525 | 0.0039 | truncated |
| 101.0959 | 23.7143 | 0.0525 | 0.0039 | truncated |
| 105.4912 | 32.2228 | 0.0525 | 0.0039 | truncated |
| 108.0575 | 41.1058 | 0.0525 | 0.0039 | truncated |
| 109.7231 | 49.9570 | 0.0525 | 0.0039 | truncated |

TABLE 6-continued

Design parameters for dimple pattern 95-3.

| Dimple Location Coordinates | | Dimple | Dimple | Dimple |
|---|---|---|---|---|
| Phi | Theta | Radius, in | depth, in | shape |
| 111.0757 | 58.8870 | 0.0525 | 0.0039 | truncated |
| 111.8182 | 67.7570 | 0.0525 | 0.0039 | truncated |
| 111.8918 | 85.5337 | 0.0525 | 0.0039 | truncated |
| 112.1065 | 76.6701 | 0.0525 | 0.0039 | truncated |
| 120.0000 | 17.9044 | 0.0525 | 0.0039 | truncated |
| 120.0000 | 27.2199 | 0.0525 | 0.0039 | truncated |
| 120.0000 | 36.1155 | 0.0525 | 0.0039 | truncated |
| 120.0000 | 45.0000 | 0.0525 | 0.0039 | truncated |
| 120.0000 | 54.0000 | 0.0525 | 0.0039 | truncated |
| 120.0000 | 63.0000 | 0.0525 | 0.0039 | truncated |
| 120.0000 | 72.0000 | 0.0525 | 0.0039 | truncated |
| 120.0000 | 81.0000 | 0.0525 | 0.0039 | truncated |
| 127.6115 | 85.5337 | 0.0525 | 0.0039 | truncated |
| 128.0702 | 76.6289 | 0.0525 | 0.0039 | truncated |
| 128.4877 | 67.7222 | 0.0525 | 0.0039 | truncated |
| 129.0314 | 58.7736 | 0.0525 | 0.0039 | truncated |
| 130.0059 | 49.9212 | 0.0525 | 0.0039 | truncated |
| 131.7379 | 41.1300 | 0.0525 | 0.0039 | truncated |
| 134.6579 | 32.3801 | 0.0525 | 0.0039 | truncated |
| 139.8129 | 23.7627 | 0.0525 | 0.0039 | truncated |
| 150.0000 | 15.5797 | 0.0525 | 0.0039 | truncated |
| 180.0000 | 9.0005 | 0.0525 | 0.0039 | truncated |
| 210.0000 | 15.5797 | 0.0525 | 0.0039 | truncated |
| 220.1871 | 23.7627 | 0.0525 | 0.0039 | truncated |
| 225.3421 | 32.3801 | 0.0525 | 0.0039 | truncated |
| 228.2621 | 41.1300 | 0.0525 | 0.0039 | truncated |
| 229.9941 | 49.9212 | 0.0525 | 0.0039 | truncated |
| 230.9686 | 58.7736 | 0.0525 | 0.0039 | truncated |
| 231.5123 | 67.7222 | 0.0525 | 0.0039 | truncated |
| 231.9298 | 76.6289 | 0.0525 | 0.0039 | truncated |
| 232.3885 | 85.5337 | 0.0525 | 0.0039 | truncated |
| 240.0000 | 17.9044 | 0.0525 | 0.0039 | truncated |
| 240.0000 | 27.2199 | 0.0525 | 0.0039 | truncated |
| 240.0000 | 36.1155 | 0.0525 | 0.0039 | truncated |
| 240.0000 | 45.0000 | 0.0525 | 0.0039 | truncated |
| 240.0000 | 54.0000 | 0.0525 | 0.0039 | truncated |
| 240.0000 | 63.0000 | 0.0525 | 0.0039 | truncated |
| 240.0000 | 72.0000 | 0.0525 | 0.0039 | truncated |
| 240.0000 | 81.0000 | 0.0525 | 0.0039 | truncated |
| 247.8935 | 76.6701 | 0.0525 | 0.0039 | truncated |
| 248.1082 | 85.5337 | 0.0525 | 0.0039 | truncated |
| 248.1818 | 67.7570 | 0.0525 | 0.0039 | truncated |
| 248.9243 | 58.8870 | 0.0525 | 0.0039 | truncated |
| 250.2769 | 49.9570 | 0.0525 | 0.0039 | truncated |
| 251.9425 | 41.1058 | 0.0525 | 0.0039 | truncated |
| 254.5088 | 32.2228 | 0.0525 | 0.0039 | truncated |
| 258.9041 | 23.7143 | 0.0525 | 0.0039 | truncated |
| 270.0000 | 15.5797 | 0.0525 | 0.0039 | truncated |
| 281.0959 | 23.7143 | 0.0525 | 0.0039 | truncated |
| 285.4912 | 32.2228 | 0.0525 | 0.0039 | truncated |
| 288.0575 | 41.1058 | 0.0525 | 0.0039 | truncated |
| 289.7231 | 49.9570 | 0.0525 | 0.0039 | truncated |
| 291.0757 | 58.8870 | 0.0525 | 0.0039 | truncated |
| 291.8182 | 67.7570 | 0.0525 | 0.0039 | truncated |
| 291.8918 | 85.5337 | 0.0525 | 0.0039 | truncated |
| 292.1065 | 76.6701 | 0.0525 | 0.0039 | truncated |
| 300.0000 | 17.9044 | 0.0525 | 0.0039 | truncated |
| 300.0000 | 27.2199 | 0.0525 | 0.0039 | truncated |
| 300.0000 | 36.1155 | 0.0525 | 0.0039 | truncated |
| 300.0000 | 45.0000 | 0.0525 | 0.0039 | truncated |
| 300.0000 | 54.0000 | 0.0525 | 0.0039 | truncated |
| 300.0000 | 63.0000 | 0.0525 | 0.0039 | truncated |
| 300.0000 | 72.0000 | 0.0525 | 0.0039 | truncated |
| 300.0000 | 81.0000 | 0.0525 | 0.0039 | truncated |
| 307.6115 | 85.5337 | 0.0525 | 0.0039 | truncated |
| 308.0702 | 76.6289 | 0.0525 | 0.0039 | truncated |
| 308.4877 | 67.7222 | 0.0525 | 0.0039 | truncated |
| 309.0314 | 58.7736 | 0.0525 | 0.0039 | truncated |
| 310.0059 | 49.9212 | 0.0525 | 0.0039 | truncated |
| 311.7379 | 41.1300 | 0.0525 | 0.0039 | truncated |
| 314.6579 | 32.3801 | 0.0525 | 0.0039 | truncated |
| 319.8129 | 23.7627 | 0.0525 | 0.0039 | truncated |
| 330.0000 | 15.5797 | 0.0525 | 0.0039 | truncated |

The balls of FIGS. 27 to 29 may be one piece or multiple piece balls, and have crossing patterns that are asymmetrical about all three axes. Where a cross over dimple pattern is combined with a ball having cross over bands and mating recesses in opposing layers, the cross over points in the dimple pattern and underlying layers may be aligned to enhance the asymmetrical effect. Table 7 below compares the MOI about each spin axis for a one piece ball with dimple pattern 25-1 of FIG. 26, dimple pattern 28-1 of FIG. 25, and the cross over dimple pattern of FIG. 28. Note the ball with the crossing dimple pattern is asymmetrical about all 3 axes as compared to the 25-1 and 28-1 balls which are asymmetrical about only 2 axes. The two orthogonal axes going through the equator have essentially the same MOI values for designs 25-1 and 28-1—this is why the Ix vs Iy differs by only 0.006% and 0.007%, respectively. In contrast, the Ix and Iy MOI differentials for the Crossing Pattern design differ by more than 12 times as much, 0.082%. This means that the crossing pattern's asymmetrical design has 3 different principle moments of inertia, whereas designs 25-1 and 28-1 only have 2 principle moments of inertia.

TABLE 7

Comparison of 25-1, 28-1 and Crossing Pattern designs

| Design | Density, g/cm^3 | Mass, g | Volume, cm^3 | Ix, g cm^2 | Iy, g cm^2 | Iz, g cm^2 | Ix vs Iz | Ix vs Iy | Iy vs Iz |
|---|---|---|---|---|---|---|---|---|---|
| 25-1, 1-piece ball | 1.00 | 40.219 | 40.219 | 72.596764 | 72.601333 | 72.831183 | −0.322% | −0.006% | −0.316% |
| 28-1, 1-piece ball | 1.00 | 40.156 | 40.156 | 72.368261 | 72.373179 | 72.724804 | −0.491% | −0.007% | −0.485% |
| Crossing Pattern, 1-piece ball | 1.00 | 40.161 | 40.161 | 72.374305 | 72.433659 | 72.697310 | −0.445% | −0.082% | −0.363% |

Any of the balls of FIGS. 1A to 24 may have one piece, two piece or multiple piece cores, one layer covers or multiple layer covers, and may have various different dimple patterns, including those of FIGS. 25 to 29.

Tables 8, 9 and 10 contain the density, volume and mass information for each of the individual layers and the complete balls for all of the ball designs of FIGS. 13 to 24 in combination with the dimple patterns 28-1 of FIG. 25 (Table 8), dimple pattern 25-1 of FIG. 26 (Table 9) and dimple pattern 95-3 of FIG. 27 (Table 10). In designs 2A, 2B, 4A, 4B and 4C the width and depth of the channels were 0.10 inches. The angle between the bands in designs 1A and 1B was 30 degrees and in design 1C the angle was 90 degrees. The angle between the channels in designs 2A and 2B was 30 degrees. The distance between the channels in designs 4A and 4D was 0.50 inches.

TABLE 8

| | Dimples | | Cover | | Mantle | | Core | | Ball | |
|---|---|---|---|---|---|---|---|---|---|---|
| Ball Design w/ Dimple Design | Density. g/cc | volume, cc | Density, g/cc | volume, cc | Density. g/cc | volume, cc | Density. g/cc | volume, cc | mass, g | volume, cc |
| 4D w/28-1 | 1.295 | 0.5347 | 1.295 | 4.1838 | | | 1.120 | 36.5006 | 45.61 | 40.15 |
| 4C w/28-1 | 1.260 | 0.5347 | 1.260 | 5.1574 | | | 1.120 | 35.5270 | 45.61 | 40.15 |
| 4A w/28-1 | 1.300 | 0.5347 | 1.300 | 4.0509 | | | 1.120 | 36.6335 | 45.60 | 40.15 |
| 2B w/28-1 | 1.300 | 0.5347 | 1.300 | 4.0666 | | | 1.120 | 36.6177 | 45.60 | 40.15 |
| 2A w/28-1 | 1.300 | 0.5347 | 1.300 | 3.9337 | | | 1.120 | 36.7506 | 45.58 | 40.15 |
| 1A w/28-1 | 1.000 | 0.5347 | 1.000 | 6.6250 | 1.200 | 6.2439 | 1.150 | 27.8154 | 45.57 | 40.15 |
| 1B w/28-1 | 1.000 | 0.5347 | 1.000 | 6.5930 | 1.200 | 6.2760 | 1.150 | 27.8154 | 45.58 | 40.15 |
| 1C w/28-1 | 1.000 | 0.5347 | 1.000 | 6.6157 | 1.200 | 6.2533 | 1.150 | 27.8154 | 45.57 | 40.15 |

TABLE 9

| | Dimples | | Cover | | Mantle | | Core | | Ball | |
|---|---|---|---|---|---|---|---|---|---|---|
| Ball Design w/ Dimple Design | Density. g/cc | volume, cc | Density, g/cc | volume, cc | Density. g/cc | volume, cc | Density. g/cc | volume, cc | mass (grams) | volume, cc |
| 4D w/25-1 | 1.295 | 0.4717 | 1.295 | 4.1838 | | | 1.120 | 36.5006 | 45.61 | 40.21 |
| 4C w/25-1 | 1.260 | 0.4717 | 1.260 | 5.1574 | | | 1.120 | 35.5270 | 45.61 | 40.21 |
| 4A w/25-1 | 1.300 | 0.4717 | 1.300 | 4.0509 | | | 1.120 | 36.6335 | 45.60 | 40.21 |
| 2B w/25-1 | 1.300 | 0.4717 | 1.300 | 4.0666 | | | 1.120 | 36.6177 | 45.60 | 40.21 |
| 2A w/25-1 | 1.300 | 0.4717 | 1.300 | 3.9337 | | | 1.120 | 36.7506 | 45.58 | 40.21 |
| 1A w/25-1 | 1.000 | 0.4717 | 1.000 | 6.6250 | 1.200 | 6.2439 | 1.150 | 27.8154 | 45.57 | 40.21 |

TABLE 9-continued

| Ball Design w/ Dimple Design | Dimples Density. g/cc | Dimples volume, cc | Cover Density, g/cc | Cover volume, cc | Mantle Density. g/cc | Mantle volume, cc | Core Density. g/cc | Core volume, cc | Ball mass (grams) | Ball volume, cc |
|---|---|---|---|---|---|---|---|---|---|---|
| 1B w/25-1 | 1.000 | 0.4717 | 1.000 | 6.5930 | 1.200 | 6.2760 | 1.150 | 27.8154 | 45.58 | 40.21 |
| 1C w/25-1 | 1.000 | 0.4717 | 1.000 | 6.6157 | 1.200 | 6.2533 | 1.150 | 27.8154 | 45.57 | 40.21 |

TABLE 10

| Ball Design w/ Dimple Design | Dimples Density. g/cc | Dimples volume, cc | Cover Density. g/cc | Cover volume, cc | Mantle Density. g/cc | Mantle volume, cc | Core Density. g/cc | Core volume, cc | Ball mass (grams) | Ball volume, cc |
|---|---|---|---|---|---|---|---|---|---|---|
| 4D w/95-3 | 1.295 | 0.5076 | 1.295 | 4.1838 | | | 1.120 | 36.5006 | 45.64 | 40.18 |
| 4C w/95-3 | 1.260 | 0.5076 | 1.260 | 5.1574 | | | 1.120 | 35.5270 | 45.65 | 40.18 |
| 4A w/95-3 | 1.300 | 0.5076 | 1.300 | 4.0509 | | | 1.120 | 36.6335 | 45.64 | 40.18 |
| 2B w/95-3 | 1.300 | 0.5076 | 1.300 | 4.0666 | | | 1.120 | 36.6177 | 45.64 | 40.18 |
| 2A w/95-3 | 1.300 | 0.5076 | 1.300 | 3.9337 | | | 1.120 | 36.7506 | 45.61 | 40.18 |
| 1A w/95-3 | 1.000 | 0.5076 | 1.000 | 6.6250 | 1.200 | 6.2439 | 1.150 | 27.8154 | 45.60 | 40.18 |
| 1B w/95-3 | 1.000 | 0.5076 | 1.000 | 6.5930 | 1.200 | 6.2760 | 1.150 | 27.8154 | 45.60 | 40.18 |
| 1C w/95-3 | 1.000 | 0.5076 | 1.000 | 6.6157 | 1.200 | 6.2533 | 1.150 | 27.8154 | 45.60 | 40.18 |

Tables 11, 12 and 13 contain the moment of inertia values for each of the principle axes of rotation for all of the individual layers of each ball design in FIGS. 13 to 24 in combination with dimple pattern 28-1 (Table 11), 25-1 (Table 12) and 95-3 (Table 13). The units for the moment of inertia values in Tables 11-13 are lb inch^2. These dimple patterns are configured such that a MOI differential between any two of the three orthogonal axes is created in the cover layer. The MOI differential in the cover layer and the MOI in the remainder of the ball are each less than the MOI differential of the entire ball, as seen in the tables below. In some embodiments, the sum of the MOI differentials of the individual parts is less than the MOI differential of the entire ball between at least two of the three orthogonal axes.

TABLE 11

| Ball Design w/ | Dimples | | | Cover | | |
|---|---|---|---|---|---|---|
| Dimple Design | Ix | Iy | Iz | Ix | Iy | Iz |
| 4D w/28-1 | 0.000763 | 0.000605 | 0.000763 | 0.005173 | 0.005173 | 0.005540 |
| 4C w/28-1 | 0.000743 | 0.000588 | 0.000743 | 0.006405 | 0.005923 | 0.006405 |
| 4A w/28-1 | 0.000766 | 0.000607 | 0.000766 | 0.004949 | 0.004949 | 0.005553 |
| 2B w/28-1 | 0.000766 | 0.000607 | 0.000766 | 0.005126 | 0.005047 | 0.005565 |
| 2A w/28-1 | 0.000766 | 0.000607 | 0.000766 | 0.004883 | 0.004803 | 0.005557 |
| 1A w/28-1 | 0.000589 | 0.000467 | 0.000589 | 0.006589 | 0.006650 | 0.006131 |
| 1B w/28-1 | 0.000589 | 0.000467 | 0.000589 | 0.006547 | 0.006608 | 0.006131 |
| 1C w/28-1 | 0.000589 | 0.000467 | 0.000589 | 0.006368 | 0.006650 | 0.006326 |
| Ball Design w/ | Mantle | | | Core | | |
| Dimple Design | Ix | Iy | Iz | Ix | Iy | Iz |
| 4D w/28-1 | | | | 0.023854 | 0.023854 | 0.023537 |
| 4C w/28-1 | | | | 0.022634 | 0.023062 | 0.022634 |
| 4A w/28-1 | | | | 0.024063 | 0.024063 | 0.023544 |
| 2B w/28-1 | | | | 0.023911 | 0.023980 | 0.023533 |
| 2A w/28-1 | | | | 0.024121 | 0.024190 | 0.023540 |
| 1A w/28-1 | 0.006340 | 0.006266 | 0.006889 | 0.015433 | 0.015433 | 0.015433 |
| 1B w/28-1 | 0.006391 | 0.006317 | 0.006890 | 0.015433 | 0.015433 | 0.015433 |
| 1C w/28-1 | 0.006605 | 0.006267 | 0.006655 | 0.015433 | 0.015433 | 0.015433 |

TABLE 12

| Ball Design w/ | Dimples | | | Cover | | |
|---|---|---|---|---|---|---|
| Dimple Design | Ix | Iy | Iz | Ix | Iy | Iz |
| 4D w/25-1 | 0.000662 | 0.000558 | 0.000662 | 0.005173 | 0.005173 | 0.005540 |
| 4C w/25-1 | 0.000644 | 0.000542 | 0.000644 | 0.006405 | 0.005923 | 0.006405 |
| 4A w/25-1 | 0.000664 | 0.000560 | 0.000664 | 0.004949 | 0.004949 | 0.005553 |
| 2B w/25-1 | 0.000664 | 0.000560 | 0.000664 | 0.005126 | 0.005047 | 0.005565 |
| 2A w/25-1 | 0.000664 | 0.000560 | 0.000664 | 0.004883 | 0.004803 | 0.005557 |
| 1A w/25-1 | 0.000511 | 0.000431 | 0.000511 | 0.006589 | 0.006650 | 0.006131 |

TABLE 12-continued

| | | | | | | |
|---|---|---|---|---|---|---|
| 1B w/25-1 | 0.000511 | 0.000431 | 0.000511 | 0.006547 | 0.006608 | 0.006131 |
| 1C w/25-1 | 0.000511 | 0.000431 | 0.000511 | 0.006368 | 0.006650 | 0.006326 |
| Ball Design w/ | Mantle | | | Core | | |
| Dimple Design | Ix | Iy | Iz | Ix | Iy | Iz |
| 4D w/25-1 | | | | 0.023854 | 0.023854 | 0.023537 |
| 4C w/25-1 | | | | 0.022634 | 0.023062 | 0.022634 |
| 4A w/25-1 | | | | 0.024063 | 0.024063 | 0.023544 |
| 2B w/25-1 | | | | 0.023911 | 0.023980 | 0.023533 |
| 2A w/25-1 | | | | 0.024121 | 0.024190 | 0.023540 |
| 1A w/25-1 | 0.006340 | 0.006266 | 0.006889 | 0.015433 | 0.015433 | 0.015433 |
| 1B w/25-1 | 0.006391 | 0.006317 | 0.006890 | 0.015433 | 0.015433 | 0.015433 |
| 1C w/25-1 | 0.006605 | 0.006267 | 0.006655 | 0.015433 | 0.015433 | 0.015433 |

TABLE 13

| Ball Design w/ | Dimples | | | Cover | | |
|---|---|---|---|---|---|---|
| Dimple Design | Ix | Iy | Iz | Ix | Iy | Iz |
| 4D w/95-3 | 0.000593 | 0.000711 | 0.000722 | 0.005173 | 0.005173 | 0.005540 |
| 4C w/95-3 | 0.000577 | 0.000692 | 0.000703 | 0.006405 | 0.005923 | 0.006405 |
| 4A w/95-3 | 0.000595 | 0.000714 | 0.000725 | 0.004949 | 0.004949 | 0.005553 |
| 2B w/95-3 | 0.000595 | 0.000714 | 0.000725 | 0.005126 | 0.005047 | 0.005565 |
| 2A w/95-3 | 0.000595 | 0.000714 | 0.000725 | 0.004883 | 0.004803 | 0.005557 |
| 1A w/95-3 | 0.000458 | 0.000549 | 0.000558 | 0.006589 | 0.006650 | 0.006131 |
| 1B w/95-3 | 0.000458 | 0.000549 | 0.000558 | 0.006547 | 0.006608 | 0.006131 |
| 1C w/95-3 | 0.000458 | 0.000549 | 0.000558 | 0.006368 | 0.006650 | 0.006326 |
| Ball Design w/ | Mantle | | | Core | | |
| Dimple Design | Ix | Iy | Iz | Ix | Iy | Iz |
| 4D w/95-3 | | | | 0.023854 | 0.023854 | 0.023537 |
| 4C w/95-3 | | | | 0.022634 | 0.023062 | 0.022634 |
| 4A w/95-3 | | | | 0.024063 | 0.024063 | 0.023544 |
| 2B w/95-3 | | | | 0.023911 | 0.023980 | 0.023533 |
| 2A w/95-3 | | | | 0.024121 | 0.024190 | 0.023540 |
| 1A w/95-3 | 0.006340 | 0.006266 | 0.006889 | 0.015433 | 0.015433 | 0.015433 |
| 1B w/95-3 | 0.006391 | 0.006317 | 0.006890 | 0.015433 | 0.015433 | 0.015433 |
| 1C w/95-3 | 0.006605 | 0.006267 | 0.006655 | 0.015433 | 0.015433 | 0.015433 |

Tables 14, 15 and 16 contain the ball mass, ball volume, ball moment of inertia values for each of the principle axes of rotation and the MOI Differential for each of the complete ball designs of FIGS. 13 to 24 in combination with dimple patterns 28-1 (Table 14), dimple pattern 25-1 (Table 15) and dimple pattern 95-3 (Table 16). The moment of inertia is expressed as "lb inch^2" units in Tables 14-16. The tables below show that the MOI differential is generally highest for the balls with dimple pattern 28-1 and 95-3, and with ball constructions 2A and 4A.

TABLE 14

| | Ball | | | | | |
|---|---|---|---|---|---|---|
| Ball Design w/ Dimple Design | mass, g | volume, cc | Ix' | Iy' | Iz' | MOI Differential |
| 4D w/28-1 | 45.61 | 40.15 | 0.028263 | 0.028263 | 0.028471 | 0.734% |
| 4C w/28-1 | 45.61 | 40.15 | 0.028297 | 0.028397 | 0.028297 | 0.356% |
| 4A w/28-1 | 45.60 | 40.15 | 0.028247 | 0.028247 | 0.028489 | 0.856% |
| 2B w/28-1 | 45.60 | 40.15 | 0.028271 | 0.028260 | 0.028491 | 0.814% |
| 2A w/28-1 | 45.58 | 40.15 | 0.028237 | 0.028226 | 0.028490 | 0.930% |
| 1A w/28-1 | 45.57 | 40.15 | 0.027773 | 0.027760 | 0.027987 | 0.812% |
| 1B w/28-1 | 45.58 | 40.15 | 0.027781 | 0.027769 | 0.027987 | 0.782% |
| 1C w/28-1 | 45.57 | 40.15 | 0.027817 | 0.027760 | 0.027948 | 0.672% |

TABLE 15

| Ball Design w/ Dimple Design | Ball mass (grams) | volume, cc | Ix' | Iy' | Iz' | MOI Differential |
|---|---|---|---|---|---|---|
| 4D w/25-1 | 45.61 | 40.21 | 0.028365 | 0.028365 | 0.028519 | 0.541% |
| 4C w/25-1 | 45.61 | 40.21 | 0.028395 | 0.028443 | 0.028395 | 0.169% |
| 4A w/25-1 | 45.60 | 40.21 | 0.028348 | 0.028348 | 0.028537 | 0.662% |
| 2B w/25-1 | 45.60 | 40.21 | 0.028373 | 0.028362 | 0.028538 | 0.620% |
| 2A w/25-1 | 45.58 | 40.21 | 0.028339 | 0.028328 | 0.028537 | 0.735% |
| 1A w/25-1 | 45.57 | 40.21 | 0.027851 | 0.027839 | 0.028023 | 0.661% |
| 1B w/25-1 | 45.58 | 40.21 | 0.027859 | 0.027847 | 0.028023 | 0.630% |
| 1C w/25-1 | 45.57 | 40.21 | 0.027895 | 0.027839 | 0.027984 | 0.521% |

TABLE 16

| Ball Design w/ Dimple Design | Ball mass (grams) | volume, cc | Ix' | Iy' | Iz' | MOI Differential |
|---|---|---|---|---|---|---|
| 4D w/95-3 | 45.64 | 40.18 | 0.028304 | 0.028315 | 0.028483 | 0.630% |
| 4C w/95-3 | 45.65 | 40.18 | 0.028347 | 0.028283 | 0.028462 | 0.632% |
| 4A w/95-3 | 45.64 | 40.18 | 0.028288 | 0.028299 | 0.028501 | 0.751% |
| 2B w/95-3 | 45.64 | 40.18 | 0.028323 | 0.028301 | 0.028503 | 0.710% |
| 2A w/95-3 | 45.61 | 40.18 | 0.028289 | 0.028267 | 0.028502 | 0.825% |
| 1A w/95-3 | 45.60 | 40.18 | 0.027813 | 0.027792 | 0.027996 | 0.731% |
| 1B w/95-3 | 45.60 | 40.18 | 0.027821 | 0.027801 | 0.027996 | 0.700% |
| 1C w/95-3 | 45.60 | 40.18 | 0.027857 | 0.027792 | 0.027957 | 0.590% |

If a ball is designed with an internal construction providing a preferred spin axis due to differential MOI between the spin axes, the dimple pattern can be designed to have the lowest lift or lift coefficient (CL) and drag or drag coefficient (CD) when the ball is spinning about the preferred spin axis, i.e. the spin axis corresponding to the highest MOI. This decouples the dimple pattern from the mechanism for creating a preferred spin axis. The differential MOI may be achieved by different specific gravity layers in the ball or by different non-spherical geometry in at least one layer, or both, as described in the above embodiments.

FIGS. 1A to 29 provide various examples of possible constructions of the pieces of a multi-piece golf ball designed to provide a preferred spin axis, combined with various patterns of outer surface features or dimples to create an MOI differential between two or all three of the spin axes. There are other possible configurations. In alternative embodiments, a ball may have a core with one or more recessed regions which the mantle does not extend into, a core may be positioned non-centrally with respect to the outer surface of the ball, a channel or band may be intermittent rather than extending continuously about the ball, or a ball layer may have projections which do not extend radially. Dimple patterns may be designed to augment the MOI differential. In the above embodiments and variations thereof, the spin axis with the highest MOI is the preferred spin axis and most importantly a golf ball with a MOI differential and preferred spin axis resists tilting of the ball's spin axis when it is hit with a slice or hook type golf club swing. The ball's resistance to tilting of the spin axis means the ball resists hooking and slicing (left or right dispersion from the intended direction of flight).

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

We claim:

1. A multi-piece golf ball, comprising:

an outer surface having a plurality of dimples configured to provide selected aerodynamic properties to the ball, and wherein the outer surface of the golf ball is divided into plural dimple areas comprising at least two bands which extend at an angle to one another around the periphery of the ball and cross over at two diametrically opposed locations and additional dimple areas defined between the two bands, the bands containing first dimples and the additional dimple areas containing second dimples, the first and second dimples having different dimple parameters;

a core comprising at least one piece;

a cover layer surrounding the core and comprising at least one piece;

at least one piece of the ball having an at least partially non-spherical first surface which faces outwards;

a second piece of the ball directly surrounding said first surface having an inwardly facing, second surface of complementary, at least partially non-spherical shape opposing said first surface;

said at least one piece of the ball having a higher specific gravity than at least one other piece;

the ball having first, second and third orthogonal axes; and the core and cover layer are configured such that the ball has a first moment of inertia (MOI) with respect to the first orthogonal axis which is higher than the MOI with respect to the second and third orthogonal axis.

2. The golf ball of claim 1, wherein the core comprises an inner core and an outer core layer surrounding the inner core, the outer core layer comprising said at least one piece having said at least partially non-spherical first surface.

3. The golf ball of claim 1, wherein the core comprises a one piece core with an outer surface comprising said at least partially non-spherical first surface.

4. The golf ball of claim 1, wherein said cover layer comprises an inner cover layer and an outer cover layer of uniform thickness which surrounds said inner cover layer.

5. The golf ball of claim 1, wherein the difference between said first MOI and the MOI relative to second and third orthogonal axes is less than 3 $gm/cm^2$.

6. The golf ball of claim 1, wherein the core and cover layer are configured such that the MOI of each orthogonal axis is different from the MOI of the other two orthogonal axes.

7. The golf ball of claim 1, wherein the features on the outer surface are configured such that the golf ball exhibits a first coefficient of drag (CD) and a first coefficient of lift (CL) when spinning about one of said orthogonal axes and the golf ball exhibits a second CD and a second CL different from the first CD and first CL, respectively, when spinning about at least one of the other two orthogonal axes.

8. The golf ball of claim 7, wherein the CD and CL are lower when the ball spins about said one orthogonal axis.

9. The golf ball of claim 1, wherein the at least partially non-spherical first surface is a completely non-spherical surface and the opposing surface is of matching non-spherical shape.

10. The golf ball of claim 1, wherein the non-spherical surface is elliptical.

11. The golf ball of claim 10, wherein the difference between a maximum and minimum radius of the elliptical surface is approximately 0.05 inches.

12. The golf ball of claim 1, wherein the at least partially non-spherical first surface has diametrically opposite flattened areas.

13. The golf ball of claim 12, wherein the second surface has inner flattened areas facing the flattened areas of the first surface, the second surface comprising an inner surface of the cover layer facing the core and the cover layer has a first thickness at the flattened areas and a second thickness spaced from flattened areas, the first thickness being greater than the second thickness.

14. The golf ball of claim 1, wherein the at least partially non-spherical first surface has a first flattened band extending around the perimeter of the surface, and the opposing second surface has a matching second flattened band in face to face engagement with the first flattened band.

15. The golf ball of claim 14, wherein the first and second flattened bands define an equatorial plane of the ball and a polar axis perpendicular to the equatorial plane, and polar regions of the at least partially non-spherical first surface comprise flattened areas.

16. The golf ball of claim 14, wherein the core comprises an inner core and a mantle layer surrounding the inner core, and said first surface is the outer surface of said mantle layer.

17. The golf ball of claim 16, wherein said mantle layer has a first thickness in the spherical part and a second thickness less than the first thickness in said flattened band.

18. The golf ball of claim 15, wherein the cover layer is of greater thickness at the polar and equatorial regions than the remainder of the cover layer.

19. The golf ball of claim 1, wherein at least one core or cover layer of the ball has regions of varying thickness.

20. The golf ball of claim 1, wherein the ball has a one piece inner core, an outer cover layer, and an intermediate layer between the core and cover layer, the first surface comprising an outer surface of said intermediate layer and the intermediate layer has at least first and second different thicknesses in at least first and second different regions of the layer.

21. The golf ball of claim 20, wherein the intermediate layer comprises an outer core layer.

22. The golf ball of claim 20, wherein the intermediate layer comprises an inner cover layer.

23. The golf ball of claim 20, wherein the difference in thickness between the two regions is in the range from about 0.03 to 0.06 inches.

24. The golf ball of claim 20, wherein the cover layer has first and second different thicknesses in first and second different regions corresponding to and overlying the first and second regions of the intermediate layer.

25. The golf ball of claim 24, wherein the first thickness is less than the second thickness in the intermediate layer and the first thickness is greater than the second thickness in the surrounding cover layer.

26. The golf ball of claim 24, wherein the first thickness is greater than the second thickness in the intermediate layer and the first thickness is less than the second thickness in the surrounding layer.

27. The golf ball of claim 24, wherein the difference between the first and second thickness in the intermediate layer and cover layer is the same, whereby the total thickness of the intermediate and cover layer is the same over the entire surface area of the two layers.

28. The golf ball of claim 2, wherein at least one of the core and cover layers has an outer surface which is non-uniform in radius.

29. The golf ball of claim 1, wherein the opposing complementary first and second surfaces are in face to face engagement with no material between the opposing surfaces.

30. The golf ball of claim 1, wherein the opposing complementary first and second surfaces comprise the outer surface of the core and the inner surface of the cover layer.

31. The golf ball of claim 1, wherein the core comprises an inner core and an outer core layer, the outer core layer has an inner surface comprising a third surface of at least partially non-spherical shape and the opposing outer surface of the inner core comprises a matching fourth surface of partially non-spherical shape.

32. The golf ball of claim 31, wherein the opposing first and second surface are part spherical and have complementary non-spherical portions and the opposing third and fourth surface are part spherical and have complementary non-spherical portions in alignment with the non-spherical portions of the first and second surfaces.

33. The golf ball of claim 1, wherein the MOI differential between the maximum and minimum MOI of the axes is no more than 2%.

34. The golf ball of claim 33, wherein the MOI differential is in the range from around 0.05% to around 2%.

35. The golf ball of claim 1, wherein two of said orthogonal axes are perpendicular x and y axes in the equatorial plane of the ball and the third axis is a z axis, and the MOI about the z axis is higher than the MOI about the x and y axes.

36. The golf ball of claim 2, wherein at least the cover and intermediate layers are of different specific gravity.

37. The golf ball of claim 1, wherein the core is of non-polybutadiene material.

38. The golf ball of claim 2, wherein the inner core is spherical and has no recessed regions.

39. The golf ball of claim 1, wherein the ball is formed from no more than three pieces, comprising a core, a mantle, and an outer cover layer.

40. A multi-piece golf ball, comprising:

a core comprising at least one piece;

a cover layer surrounding the core and comprising at least one piece;

at least one piece of the ball having an at least partially non-spherical first surface which faces outwards;

a second piece of the ball directly surrounding said first surface having an inwardly facing, second surface of complementary, at least partially non-spherical shape opposing said first surface;

said at least one piece of the ball having a higher specific gravity than at least one other piece;

the ball having first, second and third orthogonal axes; and the core and cover layer are configured such that the ball has a first moment of inertia (MOI) with respect to the first orthogonal axis which is higher than the MOI with respect to the second and third orthogonal axis, wherein the cover layer comprises an outer cover layer having an outer surface having a plurality of features configured to provide selected aerodynamic properties to the ball, wherein the features are configured to create an MOI differential in the outer cover layer alone between at least two of any of the three orthogonal axes of the ball.

41. The golf ball of claim 40, wherein the remainder of the ball apart from the outer cover layer is configured to create an MOI differential in the remainder of the ball between at least two of any of the three orthogonal axes of the ball.

42. The golf ball of claim 40, wherein outer cover layer is oriented with respect to the remainder of the ball such that the cover layer MOI differential and the MOI differential in the remainder of the ball are each less than the MOI differential of the whole ball between at least two of any of the three orthogonal axes of the ball.

43. The golf ball of claim 40, wherein outer cover layer is oriented with respect to the remainder of the ball such that the cover layer MOI differential and the MOI differential in the remainder of the ball when added together are less than the MOI differential of the whole ball between at least two of any of the three orthogonal axes of the ball.

44. A multi-piece golf ball, comprising:

a core comprising at least one piece;

a cover layer surrounding the core and comprising at least one piece;

at least one piece of the ball having an at least partially non-spherical first surface which faces outwards;

a second piece of the ball directly surrounding said first surface having an inwardly facing, second surface of complementary, at least partially non-spherical shape opposing said first surface;

said at least one piece of the ball having a higher specific gravity than at least one other piece;

the ball having first, second and third orthogonal axes; and the core and cover layer are configured such that the ball has a first moment of inertia (MOI) with respect to the first orthogonal axis which is higher than the MOI with respect to the second and third orthogonal axis, wherein the first surface has at least one outwardly projecting annular band extending around the surface, and the opposing second surface has an inwardly extending annular channel which receives said projecting band.

45. The golf ball of claim 44, wherein the first surface has a first pair of outwardly projecting annular bands extending around the surface and the second surface has a matching pair of annular channels which receive the annular bands.

46. The golf ball of claim 44, wherein the bands cross over one another at diametrically opposed cross over regions on opposite sides of the first surface.

47. The golf ball of claim 46, wherein the bands cross over at a first angle in the range from 20 degrees to 90 degrees.

48. The golf ball of claim 45, wherein the bands have an outer face and opposite sides which taper outwardly from the outer face to adjacent portions of the first surface.

49. The golf ball of claim 45, wherein the first surface has diametrically aligned first flat spots at locations spaced from the bands, and the second surface has opposing second flat spots engaging the first flat spots.

50. The golf ball of claim 45, wherein the height of the band is less than 0.05 inches.

* * * * *